US007333762B2

(12) United States Patent
Oishi et al.

(10) Patent No.: US 7,333,762 B2
(45) Date of Patent: Feb. 19, 2008

(54) FIXING APPARATUS HAVING A PRESSURIZING MECHANISM

(75) Inventors: Noboru Oishi, Tokyo (JP); Tatsuho Yoshida, Tokyo (JP); Masato Sakai, Tokyo (JP); Shigeru Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 13 days.

(21) Appl. No.: 11/061,819

(22) Filed: Feb. 18, 2005

(65) Prior Publication Data

US 2005/0185996 A1 Aug. 25, 2005

(30) Foreign Application Priority Data

Feb. 25, 2004 (JP) ..... 2004-049245
Jan. 13, 2005 (JP) ..... 2005-005864

(51) Int. Cl.
*G03G 15/20* (2006.01)

(52) U.S. Cl. ..... 399/329

(58) Field of Classification Search ..... 399/320, 399/328, 329; 347/156

See application file for complete search history.

(56) References Cited

U.S. PATENT DOCUMENTS 5,666,624 A * 9/1997 Kanesawa et al. ..... 399/329
5,873,020 A * 2/1999 Matsuura et al. ..... 399/329
6,078,780 A * 6/2000 Abe et al. ..... 399/328
6,795,678 B2 * 9/2004 Yura et al. ..... 399/329
6,865,366 B2 * 3/2005 Katayanagi et al. .... 399/328 X
6,895,208 B2 * 5/2005 Nakatogawa et al. ..... 399/329
6,928,257 B2 * 8/2005 Ogiso et al. ..... 399/329
6,983,119 B2 * 1/2006 Nakayama ..... 399/329 X

FOREIGN PATENT DOCUMENTS

JP 11-002979 A 1/1999

* cited by examiner

*Primary Examiner*—Sandra L. Brase
(74) *Attorney, Agent, or Firm*—Akin Gump Strauss Hauer & Feld LLP

(57) ABSTRACT

A fixing apparatus transports a recording medium carrying a developer image on it and heats the developer image to fix into the recording medium. A heat roller extends in a direction of its rotational axis and generates heat. An endless belt is loosely entrained on a belt guide. A pressurizing mechanism engages the endless belt from inside and urges the endless belt against the first rotating body. When the rotating body rotates, the endless belt and the second rotating body are driven in rotation in such a way that the recording medium is pulled in between the first rotating body and the endless belt.

48 Claims, 17 Drawing Sheets

FIXING APPARATUS HAVING A PRESSURIZING MECHANISM

BACKGROUND OF THE INVENTION

1. Field of the Invention

The present invention relates to a fixing apparatus incorporated in an image information recording apparatus such as copying machines, printers, and facsimile machines, and is used for heating an unfixed image on a recording medium. More particularly, the present invention relates to an improvement to a belt-nip type fixing apparatus in which an endless belt is in pressure contact with a heat roller and a recording medium passes through a nip formed between the endless belt and the heat roller.

2. Description of the Related Art

A commonly known conventional fixing apparatus for use in an image forming apparatus usually includes a heat roller having a built-in heater and a pressure roller that rotates in pressure contact with the heat roller. A recording medium carries an unfixed toner image thereon and passes through a nip formed between the heat roller and the pressure roller.

A fixing unit that employs a heat roller requires a certain amount of heat in order to fix toner. When this type of fixing apparatus is used in a color image forming apparatus, the amount of heat required is larger in color image formation than in monochrome image formation.

For color image forming apparatus, the amount of heat required per unit time is larger in high-speed image formation than in low-speed image formation.

The amount of heat supplied to a recording medium during fixing is determined by the following factors:

(1) work of a heat source (wattage=amount of heat/time length), (2) width of a nip (a dimension of a nip in a direction of travel of a recording medium), and (3) time length during which the heat roller is in pressure contact with the recording medium.

In order to increase the amount of heat supplied to the toner deposited on the recording medium, it is required to increase the wattage of a heat source, the width of a nip, or the time length during which the heat roller is in pressure contact with the recording medium. In order to fuse the toner at higher speed, it is necessary to increase the wattage of a heat source or the width of a nip because the heat roller is in pressure contact with the recording medium in a short time length. Because the heat resistance of structural members and a requirement for low power consumption place limitations on the increase in the wattage of a heat source, the wattage cannot be increased beyond a certain limit. Increasing the width of a nip between the heat roller and the pressure roller is a key factor. In order to increase the width of nip, a belt nip type fixing apparatus that employs a belt has been proposed.

FIG. 29 illustrates one such conventional belt-nip type fixing apparatus disclosed in Japanese Patent Laid-Open No. 11-2979. Referring to FIG. 29 a heat roller 101 incorporates a heat source and is rotatable. An endless belt 102 is in pressure contact with the heat roller 101 and is driven by the heat roller 101 in rotation. The endless belt 102 is entrained about a pressure roller 103 so that the endless belt 102 can rotate about the pressure roller 103. The pressure roller 103 is urged by an urging member 104, which in turn urges the endless belt 102 against the heat roller 101. The endless belt 102 is also entrained about a steering roller 105, which serves to eliminate skew of the endless belt 102. The endless belt 102 is also entrained about a support roller 106 urged by urging member 107, which urges the endless belt 102 in an opposite direction to the direction of travel of the recording medium P to apply tension to the endless belt 102. An urging member 109 urges the pressure pad 108 toward the heat roller 101, which in turn urges the endless belt 102 against the heat roller 101 from inside to increase the width of a nip formed between the heat roller 101 and the endless belt 102.

With the aforementioned fixing apparatus, the endless belt 102 needs to be stretched by a predetermined length to ensure that the endless belt 102 is entrained properly. Stretching the endless belt 102 causes more heat to be lost to the environment due to the fact that the endless belt 102 will have a larger surface area except for the nip region. In other words, the endless belt 102 is apt to become cool, allowing more heat to be transferred from the heat roller 101 to the endless belt 102 by conduction. As a result, the heat roller 101 loses a larger amount of heat, thus requiring a longer warming-up time for the fixing apparatus to become ready for fixing.

SUMMARY OF THE INVENTION

The present invention is to solve these problems and provide an expensive, reliable fixing apparatus.

A fixing apparatus transports a recording medium carrying a developer image on it and heats the developer image to fix into the recording medium, the apparatus. The fixing apparatus includes a rotating body, an endless belt, a belt guide, a belt guide, and a pressurizing mechanism. The rotating body extends in a first direction parallel to a rotational axis of the rotating body and generates heat. The endless belt runs in a second direction substantially perpendicular to the first direction. The endless belt is loosely entrained on the belt guide. The pressurizing mechanism engages the endless belt from inside and urges the endless belt against the rotating body. When the rotating body rotates, the endless belt is driven in rotation in such a way that the recording medium is pulled in between the rotating body and the endless belt.

The pressurizing mechanism includes a pressure roller and a pressure pad. The pressure roller extends substantially parallel to the rotating body and urges the endless belt against the rotating body while rotating. The pressure pad extends substantially parallel to the rotating body and has a pressure surface that urges the endless belt against the rotating body.

The pressure pad extends in the second direction and the pressure surface has a recess therein extending in the second direction.

The pressure surface has a radius of curvature.

The pressure surface has a first surface, a second surface, and a third surface that are in pressure contact with the endless belt.

The first surface is on an upstream side with respect to the second direction, the second surface is on a downstream side with respect to the second direction, and a third surface is between the first surface and the second surface. The third surface is pressed against the endless belt under a lower pressure force than the first surface and the second surface.

The fixing apparatus further includes a gap-defining member defines a gap between the pressure roller and the pressure pad.

The gap-defining member is a bearing that abuts the pressure pad to prevent the pressure pad from contacting the pressure roller.

The gap-defining member is a spacer disposed between the pressure roller and the pressure pad, the spacer being made of polytetrafluoro-ethylene.

The pressure surface has resiliency.

The pressure surface has a surface roughness expressed in terms of ten-point height of irregularities greater than 5 μm.

The pressure surface is a made of a resilient base material to which a solid lubricant is added.

The resilient base material is silicone rubber material.

The one of epoxy denatured silicone and amino (propyl trimethoxy) silane is added to the resilient base material.

The solid lubricant is one of graphite, tetrafluoroethylene, powder of tetrafluoroethylene, and molybdenum disulfide.

The pressure surface has longitudinal end portions tapered such that the pressure surface is away from the endless belt nearer longitudinal ends of the pressure surface.

The pressure roller and the pressure pad are received in the belt guide.

The pressure pad is disposed upstream of the pressure roller with respect to the second direction.

The pressure pad is formed of a bent plate-like member.

The rotating body has a cylindrical surface and the pressure pad has a curved pressure surface concentric to the cylindrical surface of the rotating body and urges the endless belt.

The belt guide accommodates the pressure pad and an urging member that urges the pressure pad against the rotating body.

The pressure pad has a pressure surface that extends in the first direction. The urging member urges the pressure pad at longitudinal end portions and longitudinal middle portions of the pressure pad, applying a larger urging force at the longitudinal middle portion than at the longitudinal end portions.

The pressure pad has a pressure surface that extends in the first direction. The urging member urges the pressure pad in such a way that the pressure surface extends toward the rotating body nearer the longitudinal middle portion.

The pressure roller has a large diameter at its longitudinal middle and a small diameter at its longitudinal ends such that the diameter of the pressure roller 7*a* is larger nearer the longitudinally middle of the pressure roller.

The fixing apparatus further includes a wear resistant member disposed between the pressure pad and the endless belt, the wear resistant member having wear resistance.

The fixing apparatus further includes a resilient member disposed between the pressure pad and the wear resistant member.

The resilient member is made of silicone resin.

The wear resistant member contains glass fiber material.

The wear resistant member further includes fluoroplastic.

The rotating body has a first dimension in the first, and the pressure roller has a second dimension in a direction parallel to the rotational axis, the first dimension and the second dimension being greater than a width of the endless belt.

The belt guide receives an oil-supplying member therein, the oil-supplying member being exposed on a surface of the belt guide in contact with the endless belt.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

First Embodiment

{Construction}

A fixing apparatus according to the present invention heats the developer on a recording medium to fix the developer while also transporting a recording medium therethrough.

Figure 1:
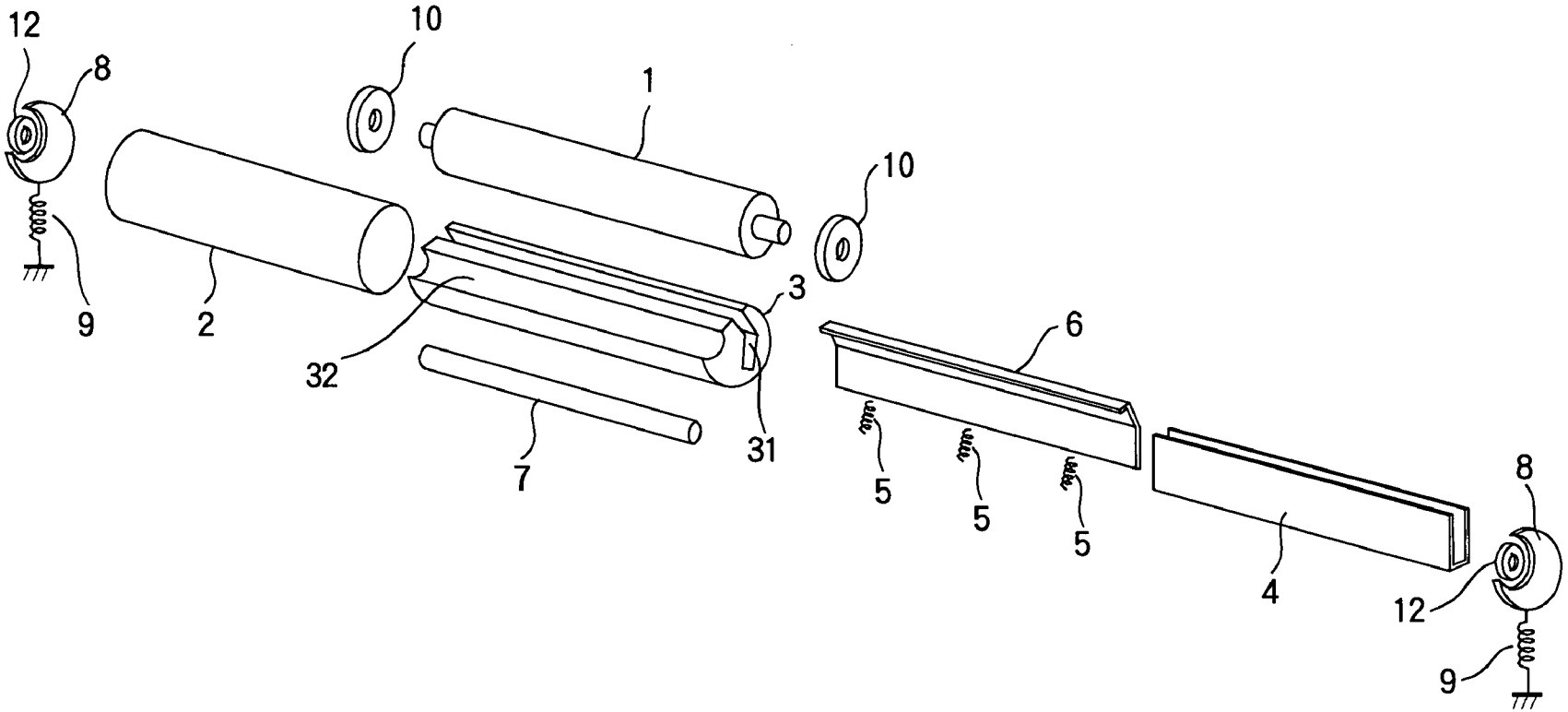
FIG. 1 is an exploded view of a fixing apparatus according to a first embodiment illustrating a general configuration of the fixing apparatus.
Figure 2:
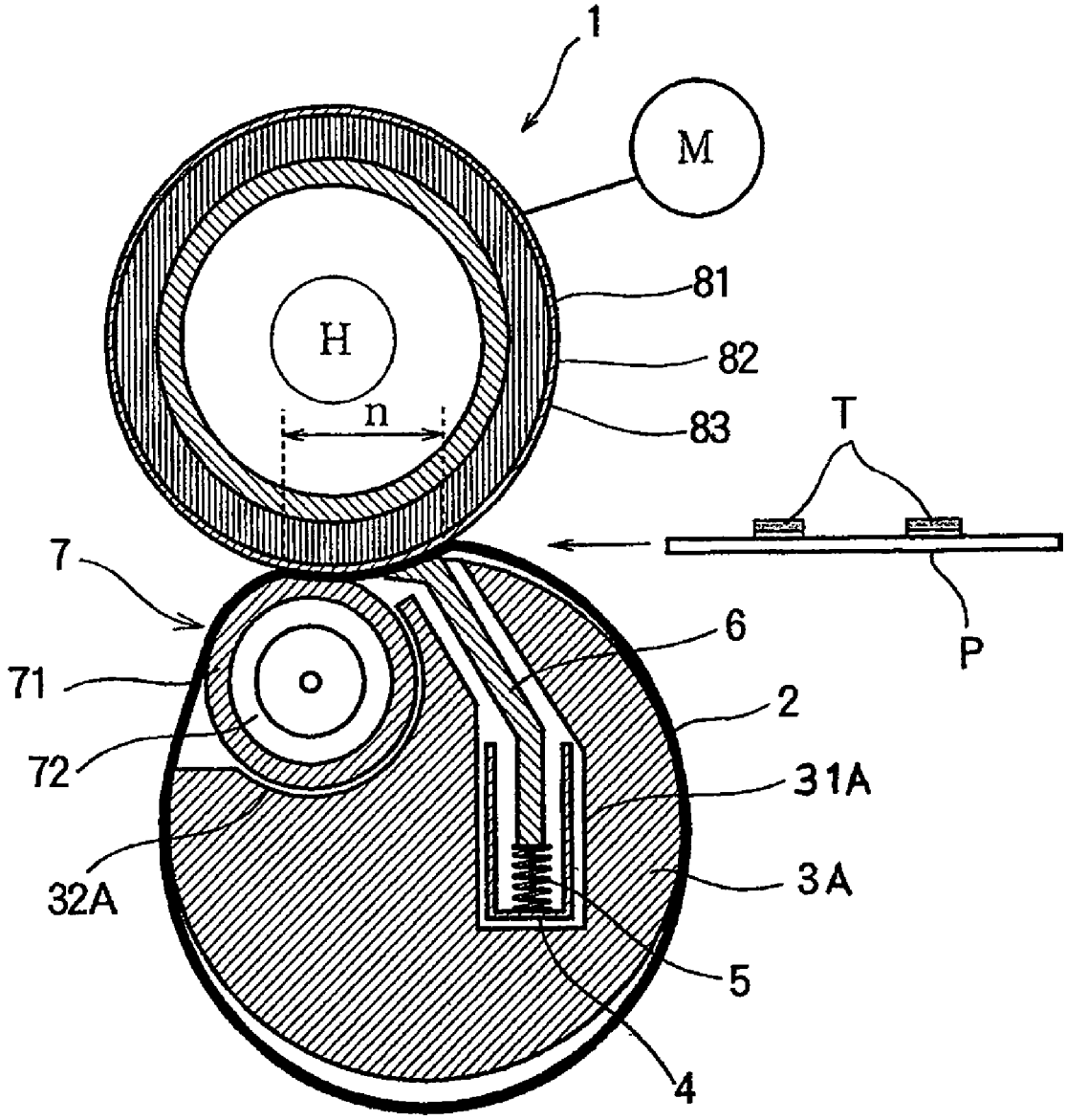
FIG. 2 is a cross-sectional view of the fixing apparatus in FIG. 1.

FIG. 1 is an exploded view of a fixing apparatus according to a first embodiment illustrating a general configuration of the fixing apparatus. FIG. 2 is a cross-sectional view of the fixing apparatus in FIG. 1.

Referring to FIGS. 1 and 2, a heat roller 1 includes a heat source and is rotatable. The heat roller 1 supplies heat to toner T at a nip region N, thereby fixing the toner T into a recording medium P. The heat roller 1 is a hollow cylindrical heating member that incorporates a heat source such as a halogen lamp. A drive source M drives the heat roller 1 in rotation. The heat roller 1 rotates to transport the recording medium P such as recording paper.

A heater H is surrounded by a metal layer 83 made from a highly heat-conductive material such as aluminum or iron. The metal layer 83 is covered with a resilient layer 82 made of, for example, silicone rubber. A tube 81 is made of a material such as perfluoro alkyl vinyl ether (PFA) having a high release properties and fits over the resilient layer 82. The tube 81 is the outermost layer of the heat roller 1. For example, the heat roller 1 has a longitudinal dimension of 350 mm and an outer diameter of 28 mm. The metal layer 83 has a thickness of 1.5 mm and the resilient layer 82 has a thickness of 1.2 mm. The thickness of 1.5 mm of the metal layer 83 is thick enough so that the metal layer 83 is rigid enough not to deflect at its middle.

The resilient layer 82 deforms to configure to the rough surface of the recording medium P and to changes in the thickness of toner of a color image carried on the recording medium P, thereby maintaining uniform fixing results. The heat roller 1 is driven by the drive source M, e.g., a motor, and drives the endless belt 2 to run.

The belt 2 runs in pressure contact with the heat roller 1. The belt 2 is required to have rigidity and resistance to heat and is therefore formed of a base material such as a metal material (e.g., nickel, stainless) or a heat-resistant resin material (e.g., polyimide referred to as PI hereinafter). The belt 2 is made thin such that the belt 2 is sufficiently flexible. For the belt 2 made of a metal material, the belt 2 has a thickness in the range of 30 to 50 μm. For the belt 2 made of PI, the belt 2 has a thickness in the range of 50 to 100 μm. In order for the belt 2 to be detached easily when a toner is stuck to the surface of the recording medium P after fixing, the outer surface of the belt 2 is coated with a resin such as PFA that has high release properties. The belt 2 is in pressure contact with the heat roller 1 and is driven by the heat roller 1 in rotation.

A belt guide 3A has a shorter circumferential length than the inner length of the belt 2. Thus, the belt guide 3A loosely supports the belt 2 from inside of the belt 2. Thus, the belt guide 3A accommodates the pressure roller 7 and a later described pressure pad 6 so that the belt 2 is guided to run reliably in its path and is not maintained in tension. The belt guide 3A is formed with grooves 31A and 32A that accommodate the pressure pad 6 and pressure roller 7, respectively.

The belt guide 3A is required to be resistant to wear and heat and is therefore made of a resin material such as polyphenylsulfide (referred to as PPS hereinafter). The belt guide 3A maintains the belt 2 in the form of a hollow cylinder. The belt guide 3A contacts the belt 2 but not in intimate contact and there is some clearance between the belt 2 and belt guide 3A such that there is no significant friction between the belt 2 and belt guide 3A.

The pressure pad holder 4 is received in the groove 31 and supports an urging member 5 that urges the pressure pad 6 against the heat roller 1.

The urging member 5 is a member such as a spring that has resiliency. As shown in FIGS. 1 and 2, a plurality of urging members 5 is aligned at equal intervals from one longitudinal end of the pressure pad to anther longitudinal end, and applies pressure to the pressure pad 6 uniformly across the length of the pressure pad 6.

The pressure pad 6 is disposed on the inside of the endless belt 2 and upstream of the pressure roller 7 with respect to a direction of travel of the recording medium P. The pressure pad 6 extends in parallel to the heat roller 1. The pressure pad 6 cooperates with the pressure roller 7 to press the belt 2 against the heat roller 1. In the first embodiment, the pressure pad 6 is a plate-like member that is bent toward the pressure roller 7 to form a pressure surface 62 (FIG. 3A) and presses the belt 2. The pressure surface 62 lies in a plane tangent to the surface of the heat roller 1. The pressure pad 6 is housed in the belt guide 3A and supports the urging members 5 that urge the pressure pad 6 against the heat roller 1.

Figure 3A:
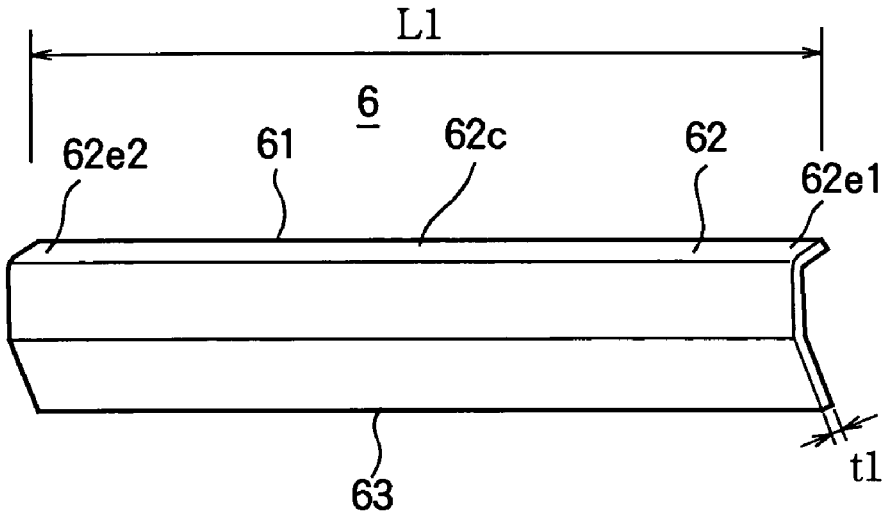
FIG. 3A is a perspective view of the pressure pad.

FIG. 3A is a perspective view of the pressure pad 6. Referring to FIG. 3A, the pressure surface 62 is flat and extends straight in its longitudinal direction.

The pressure pad 6 has a longitudinal dimension L1 of 350 mm and a thickness t1 in the range of 1 to 2 mm. The pressure pad 6 has a tapered end 61 such that the pressure pad 6 is as close to the pressure roller 7 as possible but does not contact the pressure roller 7. The pressure pad 6 is made of iron, stainless steel (referred to as SUS hereinafter), or the like so that the pressure pad 6 does not plastically deform over time.

The urging member 5 (FIGS. 1 and 2) urges the pressure pad 6 at a lower end 63 of the pressure pad 6 in such a way that the pressure surface 62 presses the belt 2 against the heat roller 1 but the belt 2 slides on the belt 2. For minimizing the sliding friction between the belt 2 and the pressure surface 62, a sheet of polytetrafluoro-ethylene (trademark is "TEFLON") may be formed on the pressure surface 62. The pressure pad 6 applies an appropriate pressure to the belt 2 and cooperates with the pressure roller 7 to ensure a large nip N between the belt 2 and the heat roller 1.

The pressure pad 6 may be made by bending the aforementioned plate-like member into a substantially L-shape or by grinding a block-like member into a substantially L-shape. However, the pressure pad 6 is preferably made by bending a plate-like member to provide the pressure surface 62 that extends straight along the heat roller 1.

The pressure roller 7 is disposed on the inside of the belt 2 and presses the belt 2 against the heat roller 1. When the heat roller 1 rotates, the drive force is transmitted from the heat roller 1 to the pressure roller 7 through friction.

Figure 3B:
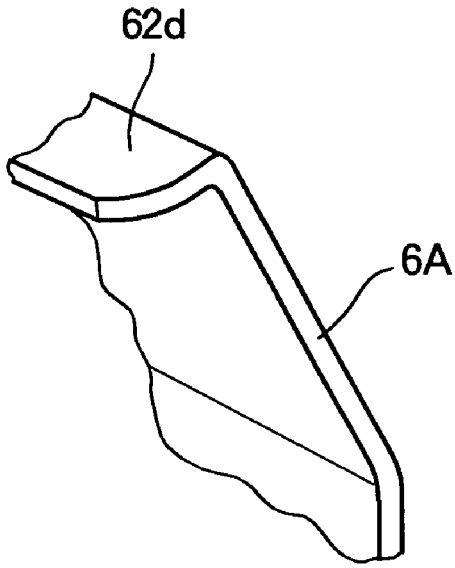
FIG. 3B is a fragmentary view illustrating a modification to a pressure pad in FIGS. 3A.

FIG. 3B is a fragmentary view illustrating a pressure pad 6A which is a modification to the pressure pad 6 in FIGS. 3A. Referring to FIG. 3B, the pressure pad 6A has a curved pressure surface 62*d* concentric to the cylindrical surface of the heat roller 1.

Figure 4:
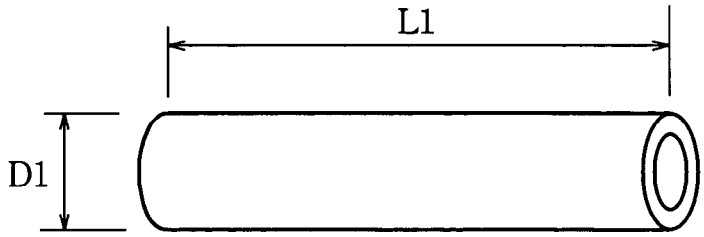
FIG. 4 is a perspective view of the pressure roller.

FIG. 4 is a perspective view of the pressure roller 7. In order that the pressure roller 7 is rigid enough to be straight, the pressure roller 7 has a core metal 72 formed of a cylinder of iron. The core 72 is covered with a thermal insulating layer 71 made of, for example, rubber or sponge. The pressure roller 7 has a length L1 of 350 mm and an outer diameter D1 of 22 mm. The thickness of the core 72 is 1.5 mm and the thickness of the thermal insulating layer 71 is in the range of 0.5 to 1 mm. The pressure roller 7 is received by bearings 12 at its longitudinal end portions (FIG. 1). The bearings 12 take the form of, for example, a ball bearing that has a very small friction coefficient.

The pressure roller 7 is formed of a resilient material or a metal that is higher in hardness than the resilient layer 82 of the heat roller 1, and forms the nip N that lies across an area between the pressure roller 7 and the pressure pad 6. The pressure roller 7 causes the resilient layer 82 to inwardly deform to make an angle θ2 at a downstream end of the nip N between a line tangent to the heat roller 1 and a direction of travel of the recording medium P. The large angle θ2 prevents the recording medium P from becoming tacked to the heat roller 1 when the recording medium P leaves the nip N.

Figure 5A:
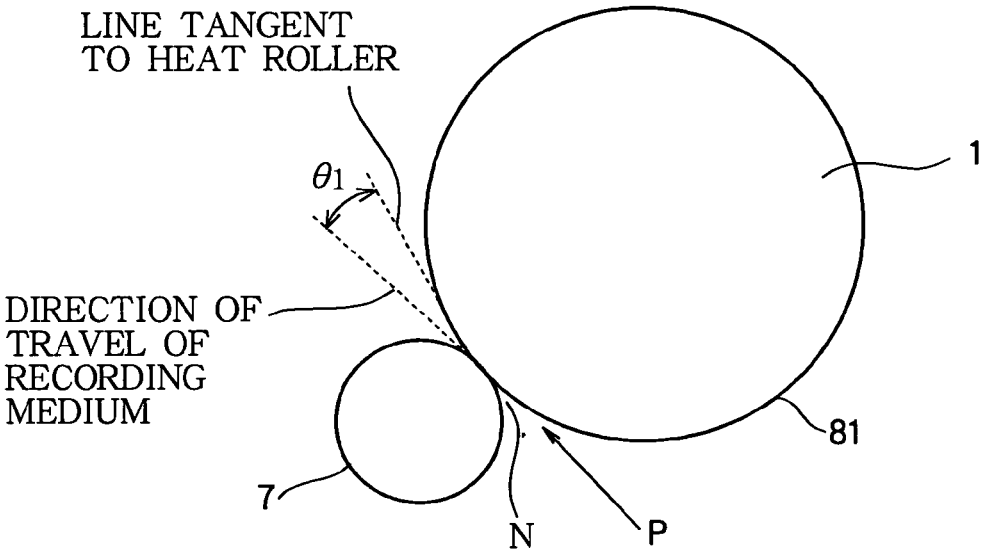
FIGS. 5A and 5B illustrate the relation between the resilient layer of the heat roller and the pressure roller when the resilient layer is deformed by the pressure roller.
Figure 5B:
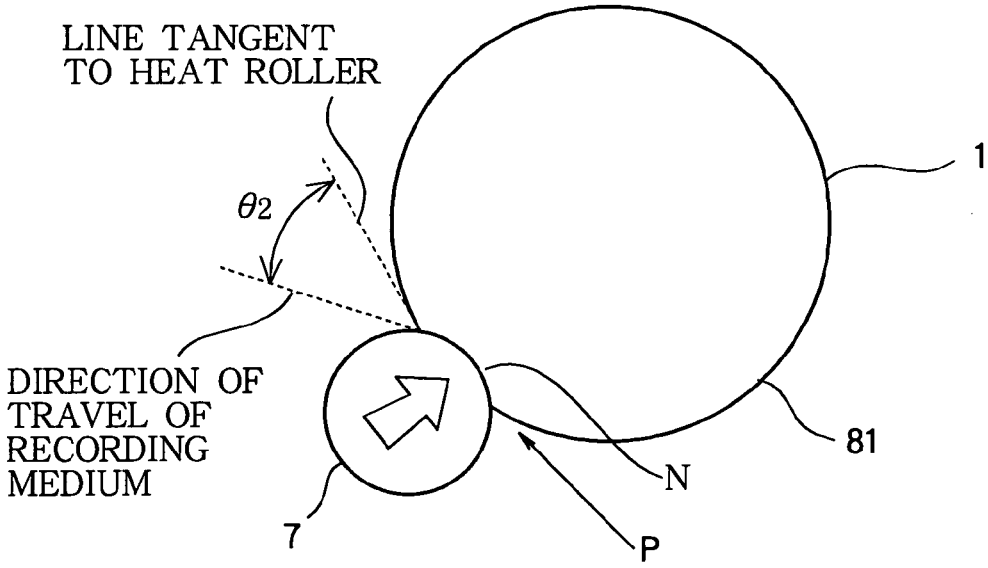

FIGS. 5A and 5B illustrate the relation between the resilient layer 82 of the heat roller 1 and the pressure roller 7 when the resilient layer 82 is deformed by the pressure roller 7. FIG. 5A illustrates an angle θ1 between a line tangent to the heat roller 1 and a direction of travel of the recording medium at an exit of the nip N when the resilient layer 82 is not resiliently deformed. FIG. 5B illustrates an angleθ2 between a line tangent to the heat roller 1 and a line tangent to the pressure roller 7 at an exit of the nip N when the resilient layer 82 is resiliently deformed. Here, angles θ1 and θ2 are related such that θ1<θ2. Thus, causing the resilient layer 82 to deform inwardly improves the ability of the fixing apparatus to detach the recording medium P from the heat roller 1 promptly after fixing.

Flanges 8 in FIG. 1 are urged by urging members 9 such as springs toward the heat roller 1 and prevent the belt 2 from becoming skewed. Each of the urging members 9 applies a urging force of, for example, 15 kg to the flanges 8. The flanges 8 support bearings 12 and are urged by the urging members 9, so that the pressure roller 7 is urged against the heat roller 1.

{Operation}

The operation of the fixing apparatus according to the first embodiment will be described. The heater H is energized to generate heat so as to supply heat to the heater roller 1. The drive source M drives the heat roller 1 in rotation and the rotation of the heat roller is transmitted through friction from the heat roller 1 to the belt 2 and the pressure roller 7.

The surface temperature of the heat roller 1 is detected by a temperature detecting means, not shown, and is controlled by a temperature controller, not shown, so as to maintain the surface temperature within a predetermined range. When the surface temperature of the heat roller 1 reaches a predetermined value, the recording medium P is advanced to the nip N where the toner T on the recording medium P is fixed.

The resilient layer 82 is resiliently deformable at the nip N, so that the surface of the resilient layer 82 deforms in accordance with the roughness in the surface of the recording medium P or the roughness created by the color toners deposited on the recording medium P. Thus, this deformation of the resilient layer 82 is effective-in fixing the image on the recording medium with uniform fixing results.

The toner T is fused into the recording medium P by the heat supplied from the surface of the heat roller 1 at the nip N. The pressure roller 7 should apply a higher pressure to the heat roller 1 than the pressure pad 6.

As shown in FIG. 5B, the pressure roller 7 causes the resilient layer 82 to deform inwardly in a radial direction, thereby creating a large angle θ2 to improve the ability of the fixing apparatus to detack the recording medium P from the heat roller 1.

The conventional fixing apparatus suffers from the problem that a belt has a large heat dissipating area and therefore a large amount of heat is lost and the sliding friction is large. Thus, the conventional fixing apparatus requires a longer warm-up time and a large electric power for generating a large driving force and a large amount of heat. In contrast, the first embodiment does not increase the length of the belt 2 while providing a large nip N. In addition, because the belt 2 is supported loosely on the belt guide 3A, heat resistance is large so that only a small amount of heat is lost to surrounding structural elements. This decreases the warm-up time.

In the first embodiment, the belt guide 3A accommodates the pressure roller 7 and pressure pad 6, and supports the pressure pad 6. This prevents excessive sliding friction and therefore implements a miniaturized fixing apparatus, so that the heat loss is minimized and the warm-up time is shortened.

Second Embodiment

{Construction}

In the first embodiment, the metal layer 83 of the heat roller 1 has a sufficient thickness such that the metal layer 83 is rigid enough at its middle. The pressure pad 6 has the flat pressure surface 62 as shown in FIG. 3, and the pressure roller 7 is a hollow cylinder as shown in FIG. 4.

A metal layer 83 according to a second embodiment is thinner than that according to the first embodiment, thereby reducing heat capacity of the metal layer 83 such that the war-up time is shorter in the second embodiment than in the first embodiment.

Figure 6:
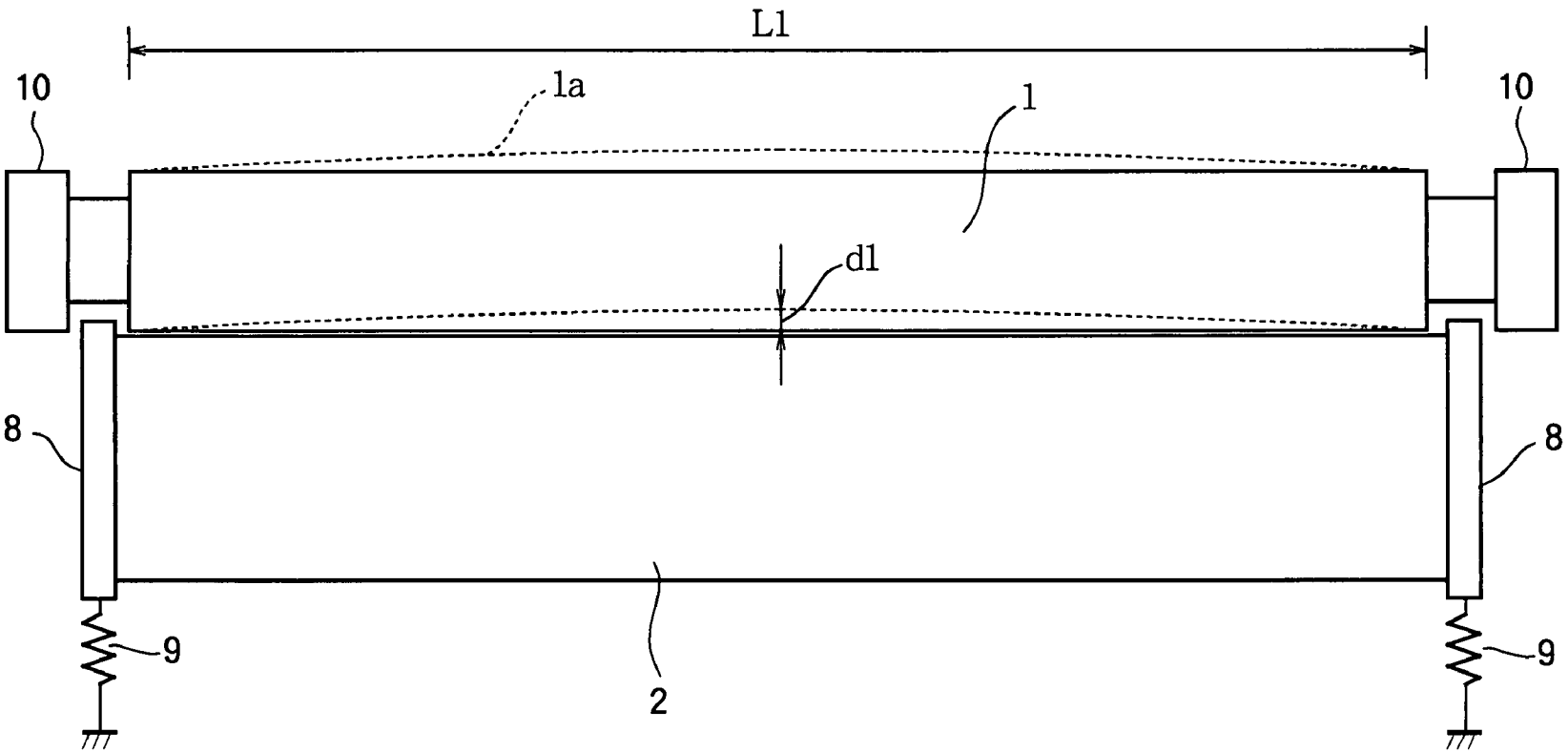
FIG. 6 is a front view of a fixing apparatus of FIG. 2.

FIG. 6 is a front view of a fixing apparatus of FIG. 2. A heat roller 1*a* has a length L1 of 350 mm and the metal layer 83 has a thickness of 1.5 mm. Solid lines indicate the contour of the heat roller 1*a* in the normal operation. Dotted lines indicate the contour of the heat roller 1*a* when the rigidity of the heat roller 1*a* is decreased, for example, when the thickness is reduced to 1 mm.

The solid lines are straight while the dotted lines are curved such that the middle portion of the heat roller 1*a* is a distance d1=0.14 mm away from a belt 2. As described, when the thickness of the metal layer 83 is reduced, the problem occurs that the pressure applied to the heat roller 1*a* is lower at its middle than at its longitudinal ends.

The configuration of the second embodiment that solves the aforementioned problem will be described. The description of elements similar to those in the first embodiment has been omitted and a description will be given only of the configuration different from the first embodiment.

A metal layer 83 of the heat roller 1*a* has a thickness of 1 mm in the second embodiment. This is smaller than the thickness of 1.5 mm in the first embodiment. In other words, the metal layer 83 is less rigid and describes a curve such that the heat roller 1*a* is a distance d=0.14 mm at its longitudinally middle portion away from the belt 2. The deflection is large.

Figure 7:
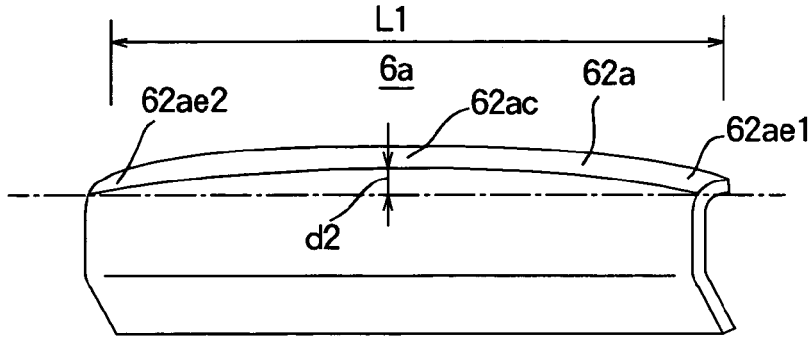
FIG. 7 illustrates a pressure pad according to the second embodiment.

FIG. 7 illustrates a pressure pad 6 according to the second embodiment. Referring to FIG. 7, a pressure pad 6*a* has a pressure surface 62*a* that extends more outwardly nearer the longitudinally middle 62*ac* of the heat roller 1*a* than at longitudinal ends 62*ae*1 and 62*ae*2. The pressure surface 62*a* extends a distance d2 more outwardly at the middle portion than at the longitudinal ends.

Figure 8:
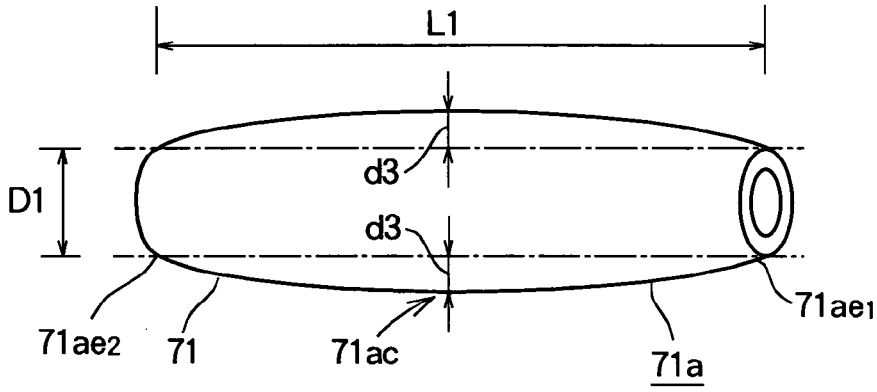
FIG. 8 illustrates a pressure roller according to the second embodiment.

Likewise, the pressure roller 7*a* has a contour different from the simple hollow cylinder in FIG. 4. FIG. 8 illustrates a pressure roller 7*a* according to the second embodiment. As shown in FIG. 8, the pressure roller 7*a* has a large diameter at its longitudinal middle and a small diameter at its longitudinal ends such that the diameter of the pressure roller 7*a* is larger nearer the longitudinally middle 71*ac* of the pressure roller 7*a*. The pressure roller 7*a* extends a distance d3 more outwardly at the middle than at the longitudinal ends. In this manner, the belt 2 is pressed against the heat roller 1*a* under an urging force uniformly applied across the width of the belt 2, and accordingly the quality of images formed are uniform across the width of the recording medium P.

The pressure pad 6*a* may be formed by deforming the pressure pad 6 in FIG. 3 to extend a distance d2=0.14 mm more outwardly at the middle than at the longitudinal ends, so that the pressure surface 62 is configured to the shape of the heat roller 1*a*. For example, a deformation V at a location on the pressure surface 62*a* is the same as that on a corresponding location on the surface of the heat roller 1*a*. By defining that X is a distance (mm) from a longitudinal end of the pressure pad 6*a* and I is an angle (degree) of the heat roller 1*a*, the deformation of the pressure pad 6*a* can be determined by the use of an equation commonly used to determine a deflection curve in the field of mechanics of materials.

The pressure roller 7*a* may be formed by deforming the pressure roller 7*a* in FIG. 4 to extend a distance d3=0.1 to 0.2 mm more outwardly at the middle 71*ac* than at the longitudinal ends 71*ae*1 and 71*ae*2, so that the pressure surface 62 is configured to the shape of the heat roller 1*a*. The pressure pad 6*a* and pressure roller 7*a* are different in the amount of deformation. This is due to the fact that the pressure roller 7*a* is covered with a thermal insulating layer 71*a*, formed of a resilient material such as rubber, sponge or the like that can accommodate dimensional errors. The deformation of the pressure pad 6*a* can be determined in the same manner as the pressure pad 6*a*.

{Operation}

The operation of the second embodiment will be described. The operation will be described with respect to that different from the first embodiment.

For implementing a shorter warm-up time, the metal layer 83 is thinner in the second embodiment than in the first embodiment. Therefore, the thinner metal layer 83 is less rigid as described above and therefore causes the heat roller 1*a* to deform more as shown in FIG. 6.

To solve this problem, the pressure pad 6*a* has a pressure surface 62*a* that extends outwardly as shown in FIG. 7 and the pressure roller 7*a* has a diameter larger nearer the middle as shown in FIG. 8, so that the belt 2 is pressed against the heat roller 1*a* under pressure uniformly distributed in the longitudinal direction of the heat roller 1*a*.

In the first embodiment, if the thickness of the metal layer 83 is decreased in an attempt to decrease heat capacity for a shorter warm-up time, the metal layer 83 becomes less rigid to cause a large amount of deflection at the longitudinally middle portion of the heat roller 1. This large amount of deflection causes a decrease in pressure at the middle portion of the heat roller 1, resulting in a difference in fixing performance between the middle portion of the heat roller 1 and the longitudinal end portions. In the second embodiment, even though the smaller thickness of the metal layer 83 of the heat roller 1*a* makes the heat roller 1*a* less rigid, the pressure surface 62*a* extends outwardly and the diameter of the pressure roller 7 becomes larger nearer the middle portion just like a barrel. The configuration of the second embodiment allows the belt 2 to be pressed against the heat roller 1*a* with uniform pressure. The difference in pressure between the middle portion and longitudinal ends of the heat roller 1*a* can be small, so that images can be formed with uniform quality and the warm-up time can be shortened.

Third Embodiment

{Construction}

The fixing apparatus according to the second embodiment is configured such that the pressure surface 62*a* of the pressure pad 6*a* extends outwardly at its middle portion to compensate for the decreased pressure at the middle portion in the longitudinal direction of a heat roller 1*a*. However, the outwardly extending pressure surface is more difficult to manufacture than the flat pressure surface.

Figure 9:
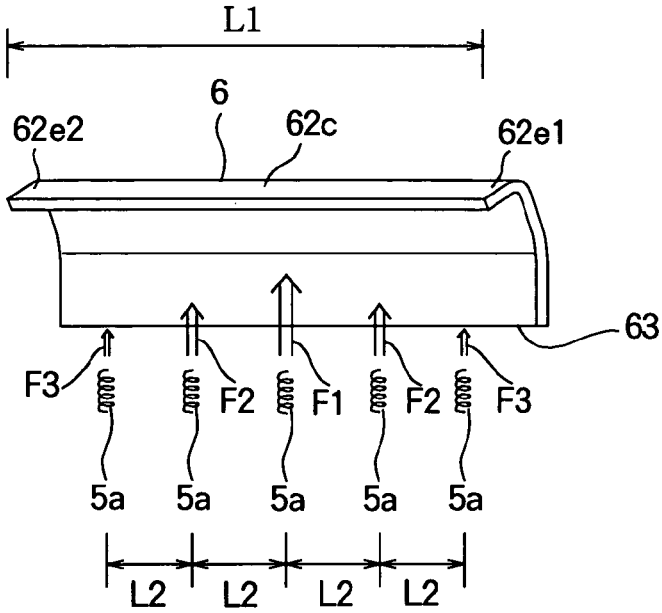
FIG. 9 is a perspective view illustrating the pressure pad and an urging member according to a third embodiment.

In a third embodiment, a pressure pad 6 has a pressure surface such as the pressure surface 62 in FIG. 7 and individual urging members 5 are designed to apply different urging forces. The pressure surface is flat when no urging force is applied to it and is slightly deformed under pressure forces applied as shown in FIG. 9. Thus, the pressure pad 6 can still apply uniform pressure to the heat roller 1*a* despite the deformation of the heat roller 1*a*.

The configuration of the third embodiment will now be described. The description will be omitted of a similar configuration to the second embodiment. The third embodiment will be described with respect to that different from the second embodiment.

FIG. 9 is a perspective view illustrating the pressure pad 6 and an urging member 5*a* according to the third embodiment. Referring to FIG. 9, a total of five urging members 5*a* are disposed under a lower end 63 of the pressure pad 6 and aligned at predetermined intervals L2 in a longitudinal direction of the pressure pad 6. The respective urging members 5*a* apply different urging forces F1-F3 to the heat roller 1*a*. The urging member 5*a* at the middle applies an urging force F1. The urging members 5*a* at the longitudinal ends apply an urging force F3. The urging member 5*a* between that at the middle and that at the longitudinal ends applies an urging force F2. The urging forces F1, F2, and F3 are related such that F1<F2<F3. In this manner, a plurality of urging members having different urging forces are disposed at predetermined intervals L2, so that the pressure surface extends more outwardly at the middle portion 62*c* than at the longitudinal ends 62*e*1 and 62*e*2.

{Operation}

The operation of the third embodiment will be described. The operation will be described with respect to that different from the first and second embodiments.

If a metal layer 83 is made to have a small thickness in an attempt to decrease heat capacity, the small thickness causes a non-uniform profile of distribution of pressure at the nip N across the length of the heat roller 1. Thus, in the third embodiment, a plurality of urging members 5 are arranged at predetermined intervals to urge the flat pressure surface of the pressure pad 6 to apply pressing forces different from urging member to urging member. The pressing force becomes larger nearer the middle portion in the longitudinal direction of the heat roller. For example, the urging force F1 at the middle portion is about 1 to 1.4 times the urging force F3 at the longitudinal end. Alternatively, two urging forces F2 and F3 may be selected to be the same and the urging force F1 may be larger than these two urging forces F2 and F3. If an odd number of urging members 5 are used, the middle one may apply a larger force than the others. If an even number of urging members 5 are used, then the two middle ones may apply a larger force than the others.

In the second embodiment, when the thickness of the metal layer 83 of the heat roller 1 is small, the pressure surface of the pressure pad 6*a* was made to extend outwardly at the middle portion. However, such a shape of the pressure surface is rather difficult to form. In the third embodiment, a plurality of urging members 5*a* are disposed at predetermined intervals L2 and the respective urging members apply different urging forces such that the urging forces become smaller nearer the longitudinal ends. Thus, the pressure surface 62*c* extends outwardly at its middle portion. The third embodiment ensures that the pressure surface applies a uniform pressing force in the longitudinal direction even though the metal layer 83 is made to have a decreased thickness. The third embodiment eliminates the need for making the pressure surface to outwardly extend at its middle portion, thereby allowing the pressure pad 6 to be machined easily.

Fourth Embodiment

{Construction}

The pressure pads 6 and 6*a* of the first to third embodiments are formed of a metal material and have a uniform thickness t1 in the range of 1 to 2 mm except for the tapered end 61. Thus, the pressure pads 6 and 6*a* have good thermal resistance and therefore are highly heat conductive. Further, the pressure pads 6*a* and 6*a* have a relatively large heat capacity. This causes the heat rollers 1 and 1*a* to lose a relatively large amount of heat to the pressure pads 6 and 6*a* through the belt 2, so that the warm-up time is long before the temperature of the heat rollers 1 and 1*a* reaches a predetermined value.

A fourth embodiment is to solve the aforementioned problems. In other words, the pressure pad has a small heat capacity and a large thermal resistance that prevents heat transfer so that heat loss is minimized.

The configuration of the fourth embodiment will be described. The configuration will be described with respect to that different from the first to third embodiments.

Figure 10:
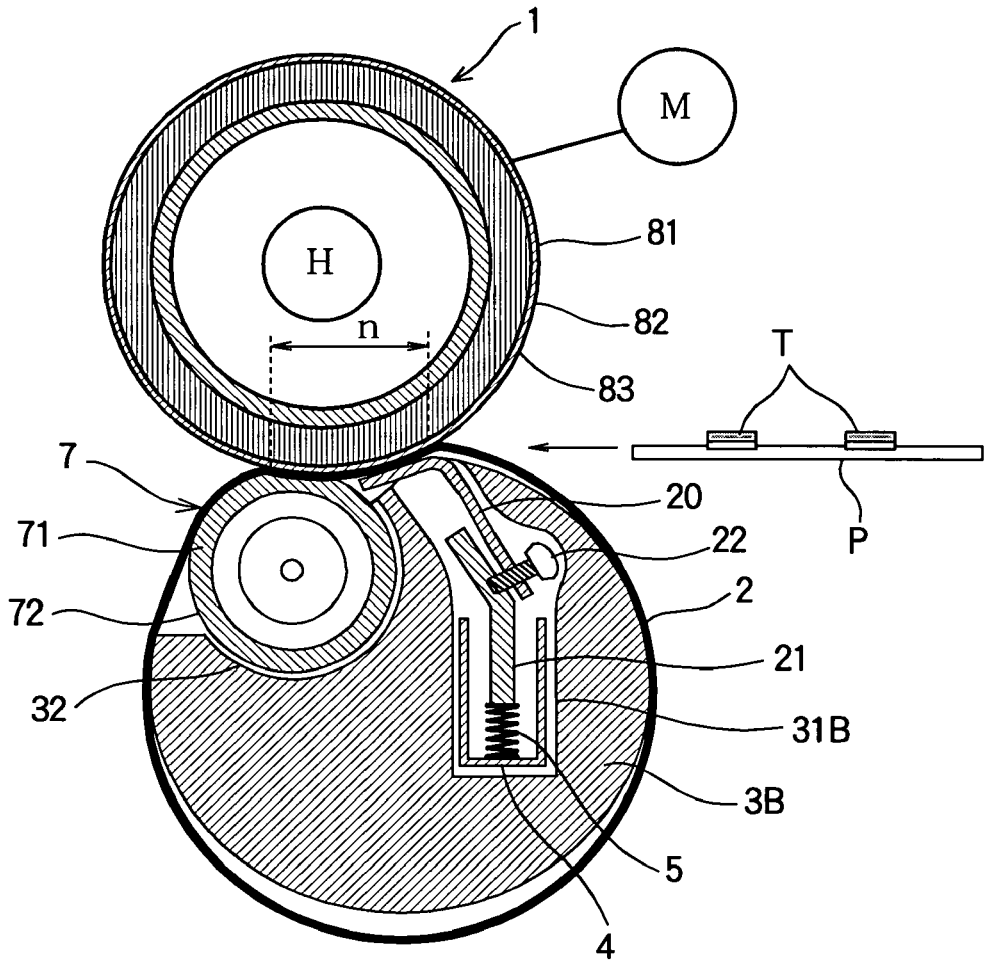
FIG. 10 is a cross-sectional view illustrating a general configuration of a fixing apparatus according to a fourth embodiment.

FIG. 10 is a cross-sectional view illustrating a general configuration of a fixing apparatus according to the fourth embodiment. Referring to FIG. 10, a pressure pad according to the fourth embodiment includes a thin plate 20 that directly presses a belt 2 and is supported by a support member 21. The thin plate 20 and the support member 21 are received in a groove 31B formed in a belt guide 3B.

The thin plate 20 is made of, for example, iron, stainless steel (referred to as SUS hereinafter) or the like so that the thin plate 20 does not plastically deform over time. Thus, at least the thin plate 20 of the thin plate 20 and the support member 21 has a resiliency. The thin plate 20 has a thickness in the range of 0.3 to 0.5 mm.

Just as the pressure pads 6 and 6*a*, the support member 21 is formed of a metal material having a thickness in the range of 0.3 to 0.5 mm.

Figure 11:
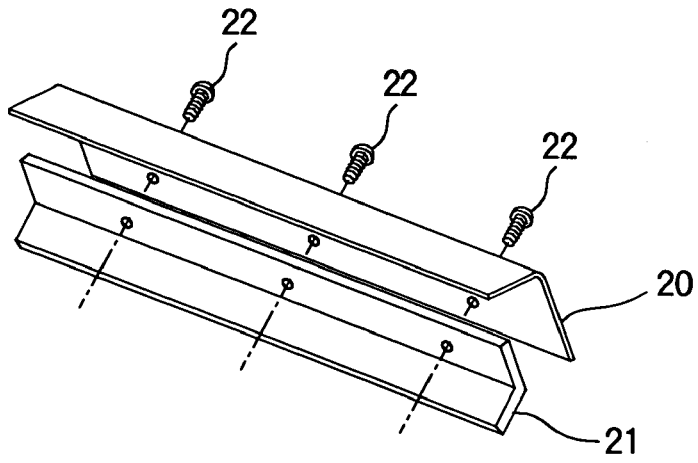
FIG. 11 is an exploded perspective view illustrating a general configuration of the pressure pad of FIG. 10.

FIG. 11 is an exploded perspective view illustrating a general configuration of the pressure pad of FIG. 10. Referring to FIG. 11, the thin plate 20 is mounted to the support member 21 by means of screws 22.

The back surface of the thin plate 20 opposite to the surface in contact with the belt 2 is not in direct contact with the support member 21, thereby minimizing heat transfer from a heat roller 1 to the support member 21.

In the fourth embodiment, the urging members 5 urge the support member 21 toward the heat roller 1 so that the thin plate 20 presses the belt 2 against the heat roller 1. The thin plate 20 urges the belt 2 to increase the area of nip N and applies pressure required for fixing.

{Operation}

The operation of the fourth embodiment will be described. The operation will be described with respect to those different from the first to third embodiments.

The thin plate 20 is not as thick as the pressure pads in the aforementioned embodiments, and presses the belt 2 against the heat roller 1. The thin plate 20 has a larger thermal resistance and a smaller heat capacity than the pressure pads 6 and 6*a* in the first to third embodiments. Thus, less heat is lost from the heat roller 1 through the belt 2.

Heat is dissipated to the support member 21 due to conduction through the thin plate 20 and through a layer of air between the thin plate 20 and the support member 21. However, air has a much higher thermal resistance than metal, so that an amount of heat dissipated through air is very small compared to that dissipated due to the conduction through the thin plate 20. Thus, the heat roller 1 loses less heat in the fourth embodiment than in the first to third embodiments.

With the fixing apparatus according to the first to third embodiments, the pressure pads 6 and 6*a* are formed of a metal material having a substantially uniform thickness. Therefore, the pressure pads 6*a* and 6*a* have a smaller thermal resistance and a larger heat capacity and therefore a large amount of heat is lost during warm-up, causing a long warm-up time of the surface temperature of the heat roller 1.

In the fourth embodiment, the thin plate 21 and the support member 21 are coupled without direct contact with each other, thereby minimizing the amount of heat that is dissipated from the heat roller 1. This shortens the warm-up time of the surface of the heat roller 1.

Fifth Embodiment

{Construction}

The pressure surface 62 of the pressure pads 6 and 6*a* of the first to third embodiments is required to be straight throughout its length or to extend outwardly at its middle portion. If the pressure surface 62 is wavy, then the pressure applied to the heat rollers 1 and 1*a* varies along the length of the heat rollers 1 and 1*a* adversely affecting the image quality. Thus, the dimensions of the pressure surface 62 should be controlled relatively closely. In contrast, the thin plate 20 of the fourth embodiment is in the shape of a flat spring having resiliency. This does not adversely affect the fixing performance of the toner T even if the thin plate 20 is somewhat wavy. However, the thin plate 20 may cause dimensional errors due to the fact that the thin plate 20 and the support member 21 are assembled together. Thus, the dimensions of the assembly should be closely controlled.

In a fifth embodiment, a resilient member 24 made of a material such as silicone is provided on a pressure surface, so that the pressure surface has some flexibility. However, the sliding friction between the belt 2 and the resilient member 24 will be larger than the friction between the belt 2 and the pressure surface of the pressure pad. Thus, a sliding member 25 having a small friction coefficient is mounted on the resilient member 24 so that the sliding member 25 is in direct contact with the belt 2.

The configuration of the fifth embodiment will now be described. The configuration will be described with respect to those different from the first to fourth embodiments.

Figure 12:
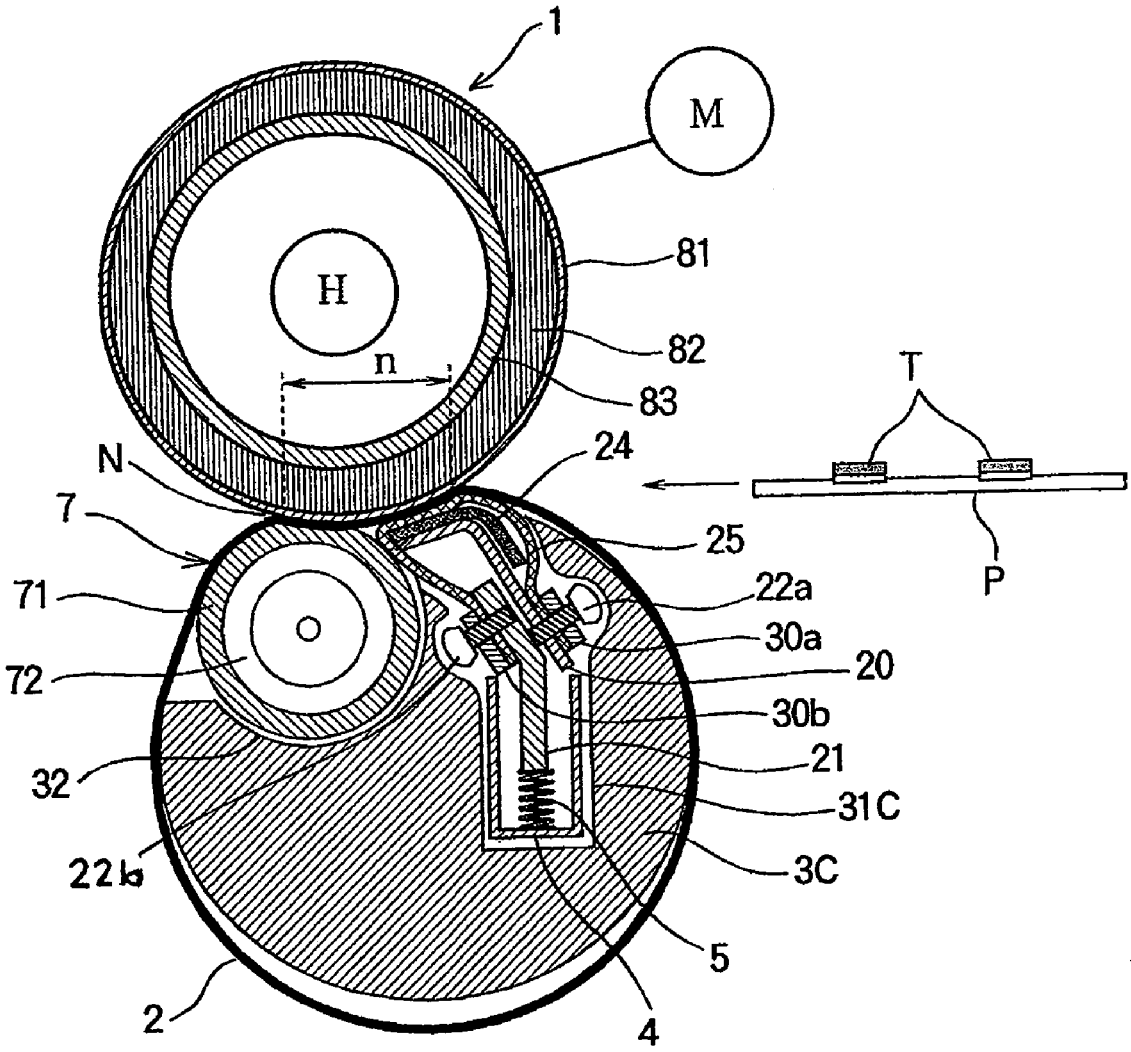
FIG. 12 is a cross sectional view illustrating a general configuration of a fixing apparatus according to the fifth embodiment.

FIG. 12 is a cross sectional view illustrating a general configuration of a fixing apparatus according to the fifth embodiment. The fifth embodiment has the following configuration in addition to that of the fourth embodiment.

The resilient member 24 made of a material such as silicone is mounted on the pressure surface of the thin plate 20 by means of, for example, an adhesive. The resilient member 24 has a thickness not smaller than 0.3 mm. For thicknesses smaller than 0.3 mm, the resilient member does not have sufficient flexibility and therefore fails to absorb the waves in the thin plate 20. Silicone rubber has a higher flexibility than iron and SUS, and therefore the dimensions of the thin plate 20 need be controlled not as closely as iron and SUS, while also allowing uniform pressure to be applied in the longitudinal direction of the heat rollers 1 and 1*a*. However, silicone suffers from the problem of increasing sliding friction as compared to metal. Thus, the resilient member 24 is covered with a sliding member 25 having a small friction coefficient.

Because the sliding member 25 is required to have thermal resistance and wear resistance, the sliding member 25 is formed of a glass fiber in which fluoroplastic is impregnated. Thus, the thin plate 20, resilient member 24, and sliding member 25 are assembled together and received in a groove 31C.

Figure 13A:
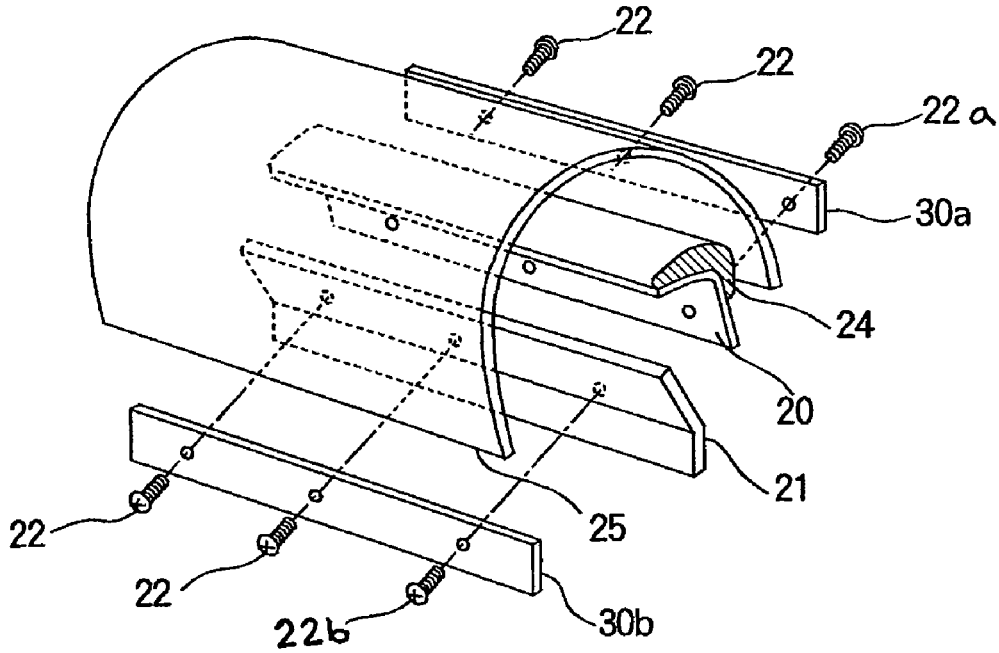
FIG. 13A is an exploded perspective view illustrating a general configuration of the pressure pad of FIG. 12.

FIG. 13A is an exploded perspective view illustrating a general configuration of the pressure pad of FIG. 12. While the resilient member 24 can be formed on the thin plate 20 without difficulty, the sliding member 25 cannot be fixed on the resilient member 24 easily.

Thus, the sliding member 25 has a dimension that can cover not only the resilient member 24 but also the thin plate 20 and the support member 21. As shown in FIG. 13A, one end of the sliding member 25 is pressed by a metal plate 30*a* at an area away from the resilient member 24 and fixed to the thin plate 20 by means of a screw 22*a*. Another end of the sliding member 25 is pressed by the metal plate 30*b* and fixed to the support member 21 by means of another screw 22*b*.

Figure 13B:
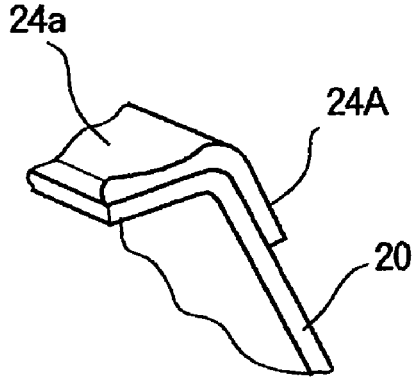
FIG. 13B is a fragmentary view illustrating a resilient member which is a modification to a resilient member in FIG. 13A.

FIG. 13B is a view illustrating a resilient member 24A, which is a modification to a resilient member 24 in FIG. 13A. Referring to FIG. 13B, the resilient member 24A has a curved pressure surface 24*a* concentric to the cylindrical surface of the rotating body 1.

{Operation}

The operation of the fifth embodiment will be described. The operation will be described with respect to that different from the first to fourth embodiments.

In the fifth embodiment, the resilient member 24 resiliently deforms to minimize the variations in pressing force exerted at the nip N in a longitudinal of the heat roller 1, the difference resulting from waves in the thin plate 20.

For example, if pressure pads 6 and 6*a* (fourth embodiment) are to be manufactured from a material that do not have elasticity or resiliency, the pressure pad needs to be manufactured without waves in the pressure surface 62. However, it is difficult to manufacture such a pressure pad. Thus, in the fourth embodiment, the dimensions of the thin plate 20, support member 21, and the assembly of the thin plate 20 and support member 21 are difficult to control closely. However, in the fifth embodiment, the resilient member 24 formed of a material such as silicone rubber on the pressure surface of the thin plate provides a flexible surface and allows images to be formed with uniform image quality. The dimensions of the thin plate 20 can be controlled without difficulty.

Because silicone rubber is more heat resistant than iron and stainless steel, the silicone rubber has high heat resistance compared to the iron and stainless steel. Therefore, the warm-up time of the surface of the heat roller 1 can be shortened.

Sixth Embodiment

{Construction}

In the fifth embodiment, for example, if the nip N is widened to increase printing speed, then the pressure pads 6 and 6*a*, thin plate 20, or resilient member 24 has a larger area in contact with the belt 2. A wider nip N may cause an increase in sliding friction between the belt 2 and the pressure surface, leading to poor running of the belt 2.

The configuration of a sixth embodiment will be described. The configuration will be described with respect to those different from the first to fifth embodiments.

Figure 14:
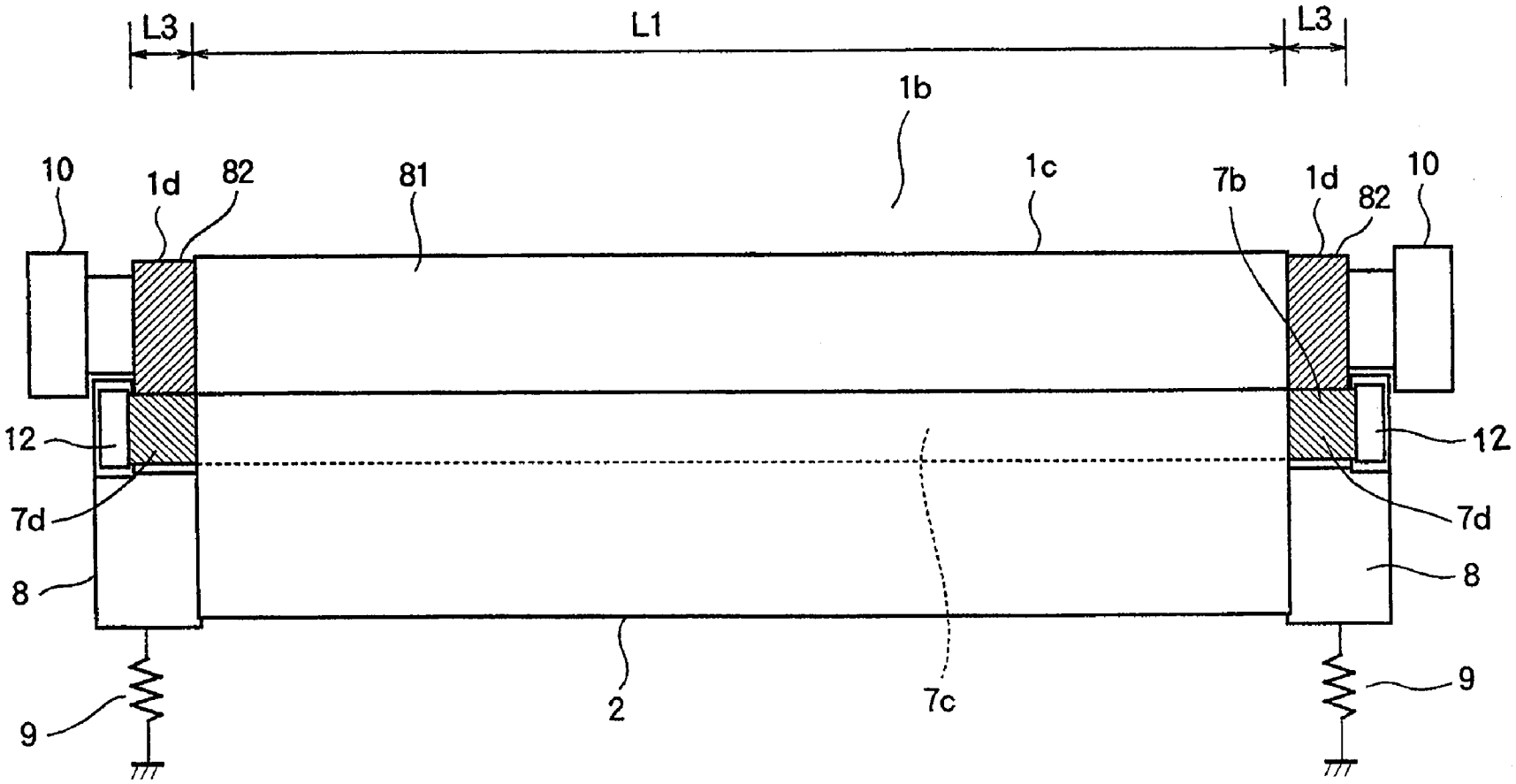
FIG. 14 is a front view of a fixing apparatus according to the sixth embodiment.

FIG. 14 is a front view of a fixing apparatus according to the sixth embodiment. Referring to FIG. 14, a heat roller 1*b* has portions 1*d* at opposite longitudinal ends of the heat roller 1*b* and a portion 1*c* between the portions 1*d*. The portion 1*c* is used for fixing the toner T on the recording medium P. A drive force is transmitted from the heat roller 1*b* to a pressure roller 7*b* primarily through the portions 1*d*. The portion 1*c* has a dimension L1=350 mm and the portions 1*d* have a dimension L3=10 mm. A tube 81 is made of a material such as perfluoro-vinyl-alkyl-ether (PFA) that has excellent release properties and covers the portion 1*c*. The portions 1*d* have no tube 81 fitted thereto but resilient layers formed of, for example, silicone rubber that increases a frictional force.

The pressure roller 7*b* also has portions 7*d* at opposite longitudinal ends of the heat roller 1*b* and a portion 7*c* between the portions 7*d*. The portion 7*c* is used for fixing the toner T on the recording medium P. A drive force is transmitted from the heat roller 1*b* to the pressure roller 7*b* primarily through the portions 7*d*. The portions 7*c* has a dimension L1=350 mm and the portion 7*d* has a dimension L3=10 mm. The portions 1*d* are in direct contact with the portions 7*d* so that the rotation of the heat roller 1*b* is directly transmitted to the pressure roller 7*b*. The aforementioned dimensions L3=10 mm are only exemplary and may be less than 10 mm if an adequate frictional force is obtained. If an adequate frictional force cannot be obtained, the dimensions L3 may be selected to be greater than 10 mm.

{Operation}

The operation of the sixth embodiment will be described. The operation will be described with respect to that different from the first to fifth embodiments. In the fifth embodiment, if the areas on the thin plate 20, resilient member 24, and sliding member 25 that are in contact with the belt 2 are increased in an attempt to increase printing speed, the friction between the sliding member 25 and the belt 2 increases not to allow the belt 2 to slide on the sliding member 25 smoothly. As a result, the drive force transmitted through the friction between the heat roller 1*b* and the belt 2 across the dimension L1=350 mm of the heat roller 1*b* is not enough to drive the belt 2 to run and the heat roller 1*b* may slip on the belt 2.

In the sixth embodiment, the heat roller 1*b* drives the pressure roller 7*b* through the friction between the portions 1*c* and the portions 7*c* and the friction between the portions 1*d* and the portions 7*d*. In other words, the drive force is also transmitted through direct friction between the portions 1*d* and the portions 7*d*.

In the previously mentioned embodiments, if the width of the nip N is to be increased for increasing printing speed, the total area in contact with the belt 2 increases and may cause poor running performance of the belt 2. However, the transmission of the drive force directly through the portions 1*d* and portions 7*d* in the sixth embodiment ensures that the belt 2 runs properly.

Seventh Embodiment

{Construction}

In the first to sixth embodiments, if the urging force of the urging members 9 is increased to apply an increased pressure on the nip N in an attempt to print on a thick recording medium, the sliding friction between the belt 2 and the area on the pressure pad 6 or 6*a*, thin plate 20, or resilient member 24 also increases. An increase in sliding friction may cause the belt 2 to improperly run or to completely stop. When the friction between the pressure members and the belt 2 is large, if the belt 2 tends to displace to one side of the heat roller, the ability of the flanges 8 to minimize the amount of skew between the belt 2 and the heat roller 1*b* is reduced. As a result, the belt 2 may buckle or run over one of the flanges 8.

In the seventh embodiment, an oil-supplying body 40 is provided in the surface of the belt guide 3 and supplies a lubricant such as silicone oil to the inner surface of the belt 2, thereby solving the aforementioned problem.

The configuration of the seventh embodiment will be described. The configuration will be described with respect to those different from the first to sixth embodiments.

Figure 15:
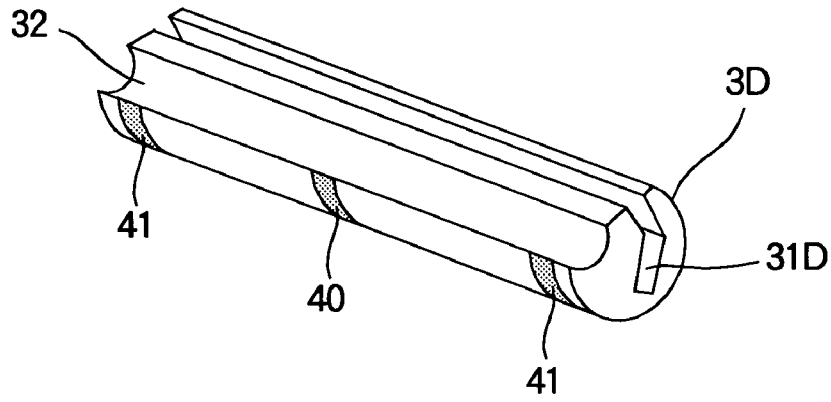
FIG. 15 is a perspective view illustrating a general configuration of a belt guide according to the seventh embodiment.

FIG. 15 is a perspective view illustrating a general configuration of a belt guide according to the seventh embodiment. The configuration of the seventh embodiment is generally the same as that of the fifth embodiment in FIG. 12, and differs only in that a belt guide 3D is added.

The belt guide 3D includes the oil-supplying body 40 in the middle of the belt guide 3D and oil absorbing bodies 41 at longitudinal end portions of the belt guide 3D. The oil-supplying body 40 supplies the lubricant and takes the form of a "felt" that holds the lubricant therein. The oil absorbing bodies 41 absorbs the oil to prevent the oil from reaching the outer surface of the belt 2.

The urging members 9 according to the seventh embodiment have a larger urging force than those in the fifth embodiment, so that the pressure applied to the nip N is also larger than that in the fifth embodiment.

{Operation}

The operation of the seventh embodiment will be described. The operation will be described with respect to those different from the first to sixth embodiments.

The overall operation of the seventh embodiment is substantially the same as that of the fifth embodiment. When the belt 2 runs, the oil-supplying body 40 supplies the oil to the inner surface of the belt 2. The oil spreads out toward the longitudinal ends of the belt guide 3D. The oil absorbing bodies 41 absorb the oil, thereby preventing the oil from spreading out to the flanges 8 so that the oil will not further spread to reach the outer surface of the belt 2. Thus, the oil is prevented from reaching the heat roller 1.

In the seventh embodiment, the oil is applied to the inner surface of the belt 2, thereby reducing the friction between the pressurizing members and the belt 2 which would otherwise increase the pressure applied to the nip N.

The oil that has spread out to the outer surface of the belt 2 causes a non-uniform gloss level across the entire recording medium P. The seventh embodiment prevents the oil from spreading out, thereby ensuring good image quality.

In the first to seventh embodiments, the belt guides 3A-3D are generally cylindrical and accommodate the pressure pads in the grooves 31A-31D and pressure rollers in the grooves 32. The belt guide according to the present invention is not limited to the belt guides 3A-3D and can be of any shapes having cross sections such as ellipse, hollow circle, cylindrical basket, semicircle, or bow-shape, provided that the belt guide holds the belt 2 loosely without tension exerted on the belt 2. The grooves 31A-31D are not limited to these shapes and can be any shapes provided that the pressure pads can be accommodated.

Eighth Embodiment

Figure 16:
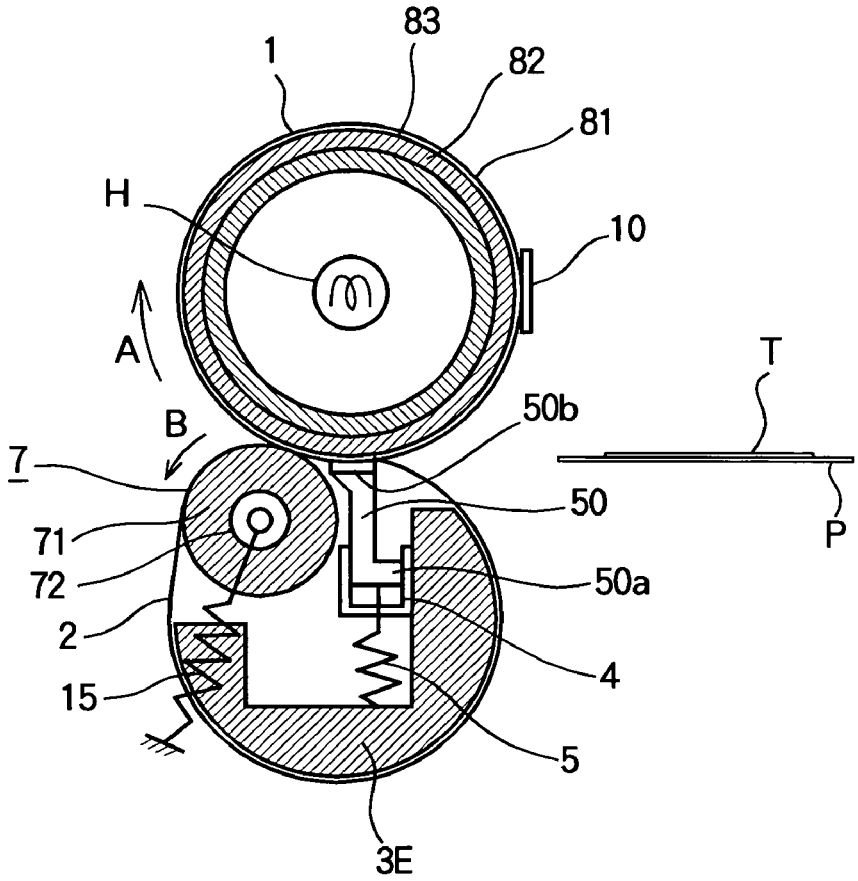
FIG. 16 is a cross sectional view illustrating a general configuration of a fixing apparatus according to an eighth embodiment.
Figure 17:
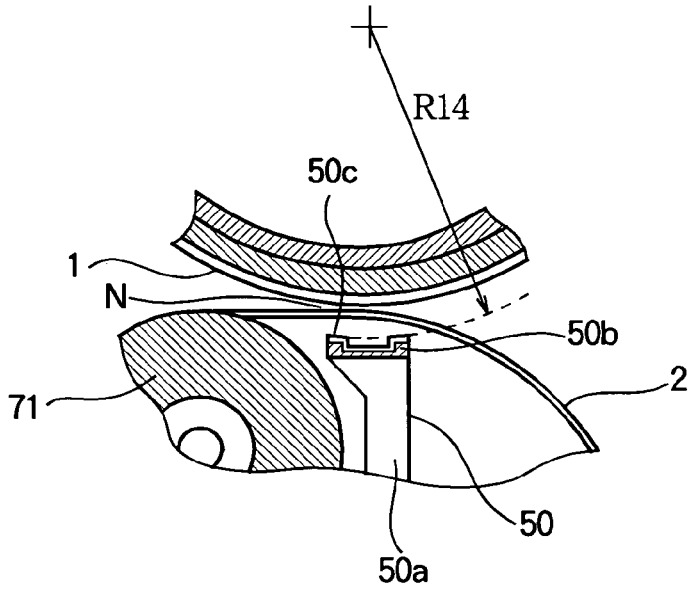
FIG. 17 illustrates the shape of a pressure pad with the pressure pad 50 separated from a heat roller and the belt.

FIG. 16 is a cross sectional view illustrating a general configuration of a fixing apparatus according to an eighth embodiment. FIG. 17 illustrates the shape of a pressure pad with the pressure pad 50 separated from a heat roller 1 and the belt 2 for purposes of illustration. The heat roller 1 is generally a hollow cylinder that has an outer diameter of 28 mm and extends in a direction of its rotational axis. The heat roller 1 incorporates a heat source H. The heat roller 1 includes a metal layer 83 made of iron and has a thickness of 1 mm. The metal layer is covered with a resilient layer 82 made of silicone rubber and has a thickness of 1.2 mm. The resilient layer 82 is covered with a PFA layer 81 having a thickness of 0.03 mm. The PFA provides good release properties. A thermistor 10 is in contact with the outer surface of the heat roller 1. An endless belt 2 is made of PI and has an outer diameter of 40 mm and a thickness of 0.09 mm. The pressure roller 7 is generally a hollow cylinder that extends in a direction of its rotational axis. The pressure roller 7 includes a hollow core metal made of iron that is covered with a thermal insulating layer 71. The thermal insulating layer 71 is made of silicone rubber and has a thickness of 2 mm. The core metal 72 may also be made of aluminum or other metal material.

A pressure pad 50 has an aluminum body 50*a* and extends in parallel to the heat roller 1. Urging members 5 are housed in a belt guide 3E and urge the belt 2 from inside against the heat roller 1. Urging members 15 are mounted between a frame of the fixing apparatus, not shown, and the pressure roller 7. The Urging members 15 urge the pressure roller 7 in such a way that the pressure roller 7 urges the belt 2 from inside against the heat roller 1 to form a nip N between the heat roller 1 and the belt 2. The pressure pad 50 has an end portion on which a resilient body 50*b* made of silicone rubber is mounted. The resilient body 50*b* has a surface area covered with a coating 50*c* such as PFA that is resistant to heat and has the ability to slide on the belt 2. The coating 50*c* is in direct contact with the belt 2. The resilient body 50*b* has portions upstream and downstream with respect to the direction of travel of the recording medium P and a recessed portion between the upstream and downstream portions. The upstream and downstream portions have the same radius of curvature (14 mm) as the heat roller 1. When the urging member 5 urges the pressure pad 50, the pressure pad 50 is pressed against the belt 2 under a smaller force at the recessed portion than at the upstream and downstream portions. The areas of the upstream portion, recessed portion, and downstream portion in contact with the belt 2 are in proportions of 1:2:1. The proportions of these areas are only exemplary and may be modified as required. A plurality of recessed portions may be used. The thickness of the upstream portion, downstream portion and the recessed portion are about 1.5 mm, 1.5 mm, and 0.2 to 0.5 mm, respectively. The rubber that forms the pressure pad 50 has a hardness of 20 to 60° according to Japanese Industrial Standard JIS-A.

The pressure pad 50 is assembled in a pressure pad holder 4 and is slidably movable in such a direction as to press the belt 2. The urging members 5 urge the pressure pad 50 against the heat roller 1. The urging force is 6 kgf and is exerted on the heat roller 1 across a width of A3 paper, i.e., a length of 350 mm. The belt holder 3 extends parallel to the heat roller 1 through the inside of the endless belt 2. The belt holder 3 and the pressure pad holder 4 are supported on side plates, not shown, located outside of the path of the belt 2. The belt guide 3 has a peripheral length shorter than the inner peripheral length of the belt 2, so that the belt guide 3 can support loosely the belt 2 from inside. This allows the belt 2 to run reliably.

When a printing operation initiates, the heat roller 1 rotates in a direction shown by arrow A in FIG. 16 and drives the belt 2 to rotate in a direction of arrow B. The heat generated by the heat source H is transmitted to the surface of the heat roller 1. When the thermistor 10 detects that the surface temperature of the heat roller 1 has reached a temperature sufficient for fixing, a recording medium P carrying toner T thereon is fed into the nip N formed between the belt 2 and the heat roller 1. The toner T is fused by the heat supplied from the heat roller 1.

Figure 18:
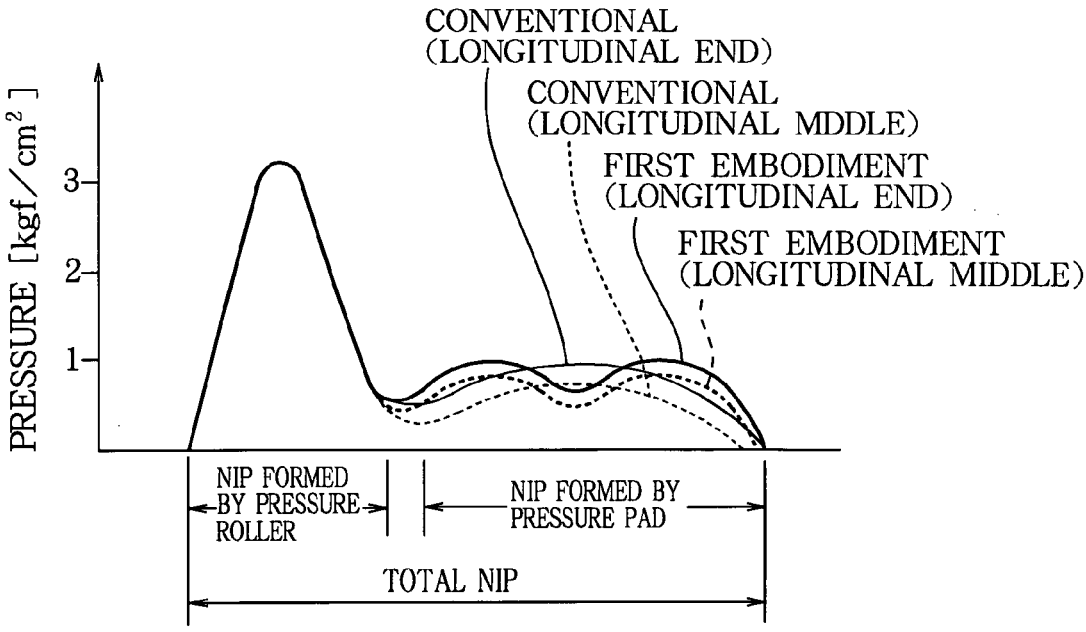
FIG. 18 illustrates a profile of distribution of pressure force exerted on the heat roller by the pressure roller and pressure pad.

FIG. 18 illustrates a profile of distribution of pressure force exerted on the heat roller 1 by the pressure roller 7 and pressure pad 50. The distribution of the pressure force exerted by the pressure pad 50 has two peak values about a dent in the middle. Therefore, even if the pressure pad 50 has a warp in the longitudinal direction of the pressure pad 50, the difference in nip-width between the middle portion of the pressure pad 50 and longitudinal ends can be small compared to the conventional art. This ensures stable, reliable fixing performance.

By providing a recessed portion between an upstream portion and a downstream portion, the pressure force is apportioned into the upstream portion and the downstream portion. This apportionment increases shrinkage of the resilient body, so that a thin resilient body can still absorb variations of nip width resulting from the warp of the pressure pad 50 in the longitudinal direction. This allows forming of more uniform nip in the longitudinal direction of the pressure pad 50, stabilizing the fixing performance, and implementing of a reliable fixing apparatus.

Ninth Embodiment

Figure 19:
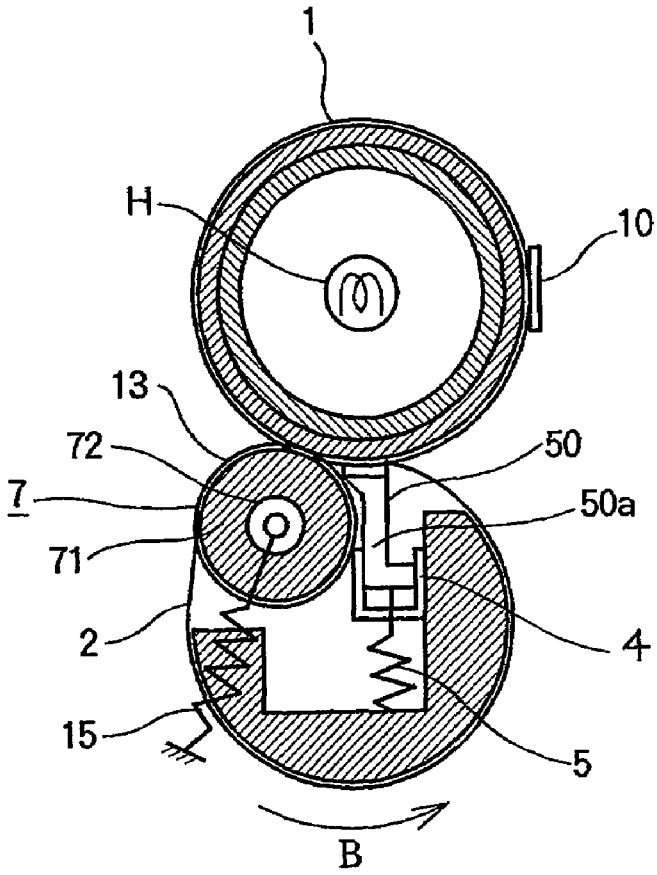
FIG. 19 is a cross-sectional view illustrating a ninth embodiment.
Figure 20:
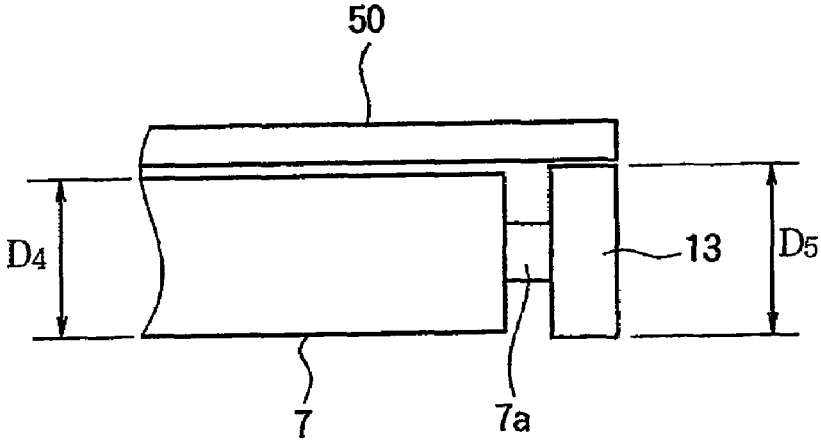
FIG. 20 is a fragmentary view of an end portion of a pressure roller and a pressure pad.

FIG. 19 is a cross-sectional view illustrating a ninth embodiment. FIG. 20 is a fragmentary view of an end portion of a pressure roller 7 and a pressure pad 50. The pressure pad 50 is longer than the pressure roller 7, so that the end portion of the pressure pad 50 extends as far as a bearing 13 of the pressure roller 7. The bearings 13 have an outer diameter D5 slightly larger than the outer diameter D4 of the pressure roller 7. For example, the difference in outer diameter between the pressure roller 7 and the bearing 13 is in the range of 0.3 to 1.0 mm. The pressure pad 50 is received in a pressure pad holder 4 and is movable in such a direction as to press the belt 2. When the belt 2 runs in a direction shown by arrow B in FIG. 19, the pressure pad 50 may incline a certain distance toward the downstream side of the direction of travel of the belt 2. The longitudinal end portions of the pressure pad 50 abut the bearings 13 and are not allowed to contact the pressure roller 7. Thus, the inclination of the pressure pad 50 does not interfere with the rotation of the pressure roller 7 and therefore the belt 2 is allowed to run reliably.

Tenth Embodiment

Figure 21:
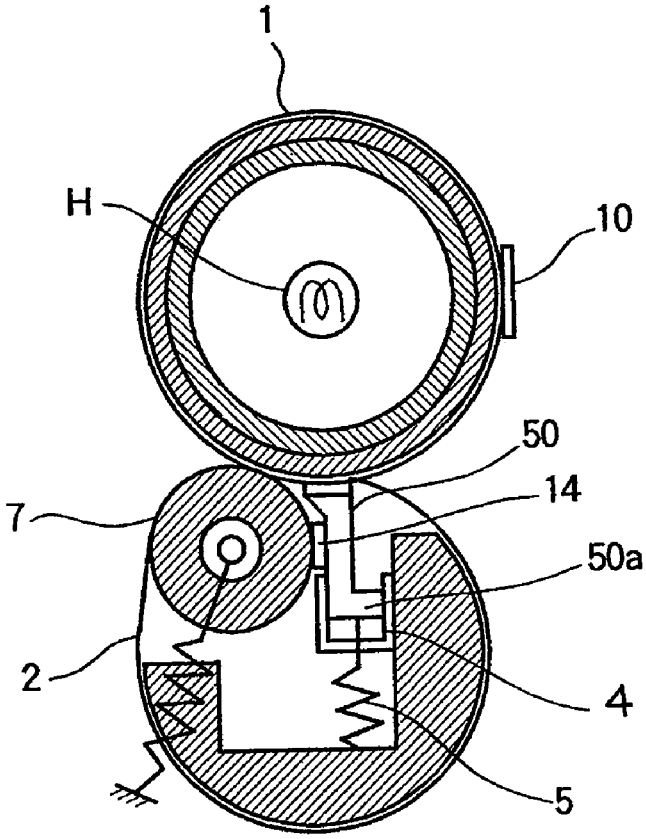
FIG. 21 is a cross-sectional view illustrating the tenth embodiment.
Figure 22:
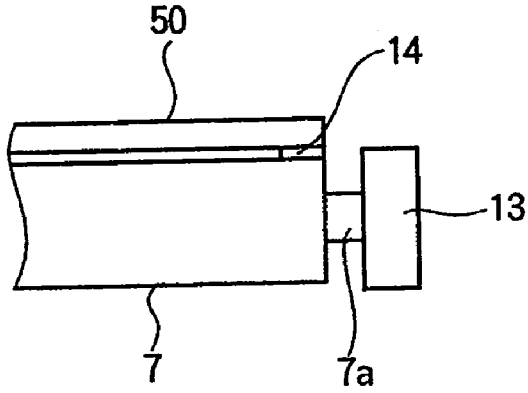
FIG. 22 is a fragmentary view illustrating the positional relation between a pressure roller and a pressure pad.

The configuration of a fixing apparatus according to a tenth embodiment is substantially the same as that of the eighth embodiment in FIG. 16. FIG. 21 is a cross-sectional view illustrating the tenth embodiment. FIG. 22 is a fragmentary view illustrating the positional relation between a pressure roller 7 and a pressure pad 50. There are provided spacers 14 on the surface of longitudinal end portions of the pressure roller 7. The spacers 14 are made of a material such as polytetrafluoro-ethylene or a glass fiber in which fluoroplastic is impregnated, the material having resistance to heat and resistance to sliding friction. The spacers 14 may be plated or coated so that the surface of the spacers 14 is resistant to sliding friction.

The pressure pad 50 presses the belt 2 against the heat roller 1 with the spacers 14 in contact with the pressure roller 7. The surface areas of pressure roller 7 and spacers 14 are slidable one over the other smoothly and do not interfere with the rotation of the pressure roller 7.

The spacers 14 are effective in maintaining the positional relations among the pressure pad 50, pressure pad holder 4, and side plate, and therefore provides a desired size of nip without closely controlling dimensional errors of these individual structural elements.

Eleventh Embodiment

The configuration of a fixing apparatus according to an eleventh embodiment is substantially the same as that of the eighth embodiment in FIG. 16. When the fixing apparatus is operating, a belt 2 and a pressure pad 50 slide one over the other while the other structural members rotate. The friction between the pressure pad 50 and the belt 2 exerts a load on the rotational shaft of a heat roller 1. This load represents a large percentage of the total load exerted on the shaft of the heat roller 1. Thus, if the friction between pressure pad 50 and belt 2 is maintained small, the operation of the fixing apparatus is stable and reliable.

In the eleventh embodiment, the resilient body 50*b* of the pressure pad 50 is formed of thermosetting silicone rubber. The surface of the resilient body 50*b* is coated with a material that contains graphite as a solid lubricant. The surface roughness of the coating is selected to be better than Rz=5 μm (ten-point height of irregularities). Roughness of the coating surface can be created either by sandblasting the inner surface of the mold or by changing conditions in which the surface is coated.

Figure 23:
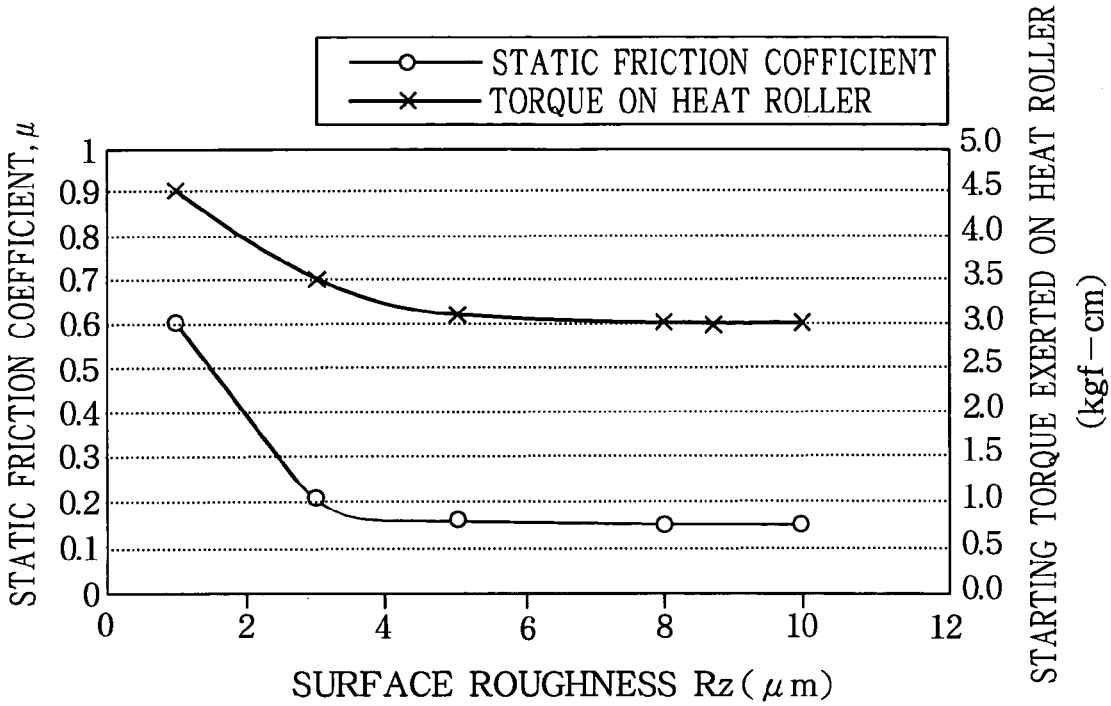
FIG. 23 illustrates the relation between the roughness of a sliding surface and the friction coefficient.

The ability of the surface of the pressure pad to slide on the belt 2 can be expressed in terms of friction coefficient. FIG. 23 illustrates the relation between the roughness of a sliding surface and the friction coefficient. FIG. 23 plots the surface roughness Rz as the abscissa and the static friction coefficient μ of the coating in contact with the belt 2 as the ordinate. Test pieces were prepared by using the same materials as the pressure pad 50 and the resilient body 50*b*. The belt 2 was cut and opened into a sheet. The test piece was set on the sheet under the same load as the actual case by using the Model 14 HEIDON TRIBO GEAR (available from SHINTO SCIENTIFIC CO., LTD, JAPAN) and friction coefficient was measured.

The graphs in FIG. 23 reveal that a small surface roughness of the coating causes a large static friction. It is considered that the belt 2 has a smaller surface roughness than the coating (Rz<0.1 μm) and therefore if the surface roughness of the coating is made as smooth as the surface of a mirror, then the pressure pad 50 and belt 2 are in intimate contact with each other. Conversely, if the surface roughness of the coating increases, the static friction coefficient decreases and reaches a constant value for Rz greater than 5.

FIG. 23 illustrates the relation between the torque load exerted on the shaft of the heat roller 1 and the surface roughness of the coating applied on the pressure pad 50. FIG. 23 reveals that the load torque becomes stable at a low value for ten-point height of irregularities Rz greater than 5 μm. Thus, the plots in FIG. 23 show that there is a certain relation between the friction coefficient and the torque load.

As described above, the coating on the resilient body 50*b* according to the eleventh embodiment has a surface roughness greater than Rz=5 μm. This surface roughness allows the pressure pad 4 and belt 2 to slide one over the other, so that the torque load on the heat roller 1 can be small and stable. The eleventh embodiment provides stable operation of the fixing apparatus and is advantageous in implementing a reliable and miniaturized fixing apparatus.

Twelfth Embodiment

In the eighth embodiment, the surface of the resilient body on the pressure pad 50 is coated as shown in FIG. 16. This coating is formed of thermosetting silicone rubber as a first base material and covered with additives such as epoxy denatured silicone, silane coupling agent (hardening accelerator), or graphite (solid lubricant). The inventors tested the following four types of coatings and made the invention according to the twelfth embodiment.

Table 1 lists the types of coatings and their evaluation. The coatings contain graphite as a solid lubricant. The surface has a roughness of ten-point height irregularities Rz=8 μm. For ten-point height irregularities Rz greater than 5 μm, though not listed in Table 1, equivalent results to those in Table 1 were obtained. The base material of the coating is required to withstand a surface temperature of 180°. To fulfill this requirement, the coating is formed of, for example, epoxy resin, denatured polyamide (referred to a denatured PAI hereinafter), silicone rubber, or silicone rubber plus a hardening accelerator. Evaluation was made in terms of the static friction coefficient between the coating and the belt, the adhesive properties between the coating and silicone rubber, and the durability of the pressure pad 50. The static friction was measured in the same manner as in the eleventh embodiment.

TABLE 1

| Base material | A epoxy | B denatured PAI | C silicone | D silicone + epoxyde-natured silicone + amino silane |
|---|---|---|---|---|
| static friction coefficient | 0.16 | 0.16 | 0.15 | 0.17 |
| adhesive properties | Good | No Good | Good | Good |
| durability (number of pages printed before damage) | 10 K | — | 120 K | >200 K |
| Damage | crack | — | crack/ flake | No damage |

Solid lubricant: graphite

Surface roughness: Rz 8

Test pieces were made of the same material as the resilient body of the pressure pad 50. Adhesive properties were tested by a tape peeling test according to JISD0202. The pressure pad 50 in the durability test had a longitudinal dimension of 350 mm that is used for fixing A3 size paper. The sliding surface of the resilient body has a width (direction of travel of the belt) of 3 mm and is pressed by a force of 6 kg. A printer was operated to perform continuous printing on A4 size paper at a rate of 40 pages per minute. The torque load was measured at predetermined intervals. The lifetime of the fixing apparatus is printing 100K pages of A4 size. The tolerable torque load is 8 kgf-cm, which is equivalent to the load on the shaft of the heat roller 1 that serves as a drive roller. Any load exceeding this causes instability of the heat roller and the motor is pulled out of synchronism finally.

The ability of the test pieces to slide on the belt 2 did not vary over a wide range. Denatured PAI did not show as good adhesive properties as the other materials. Thus, only pressure pads formed of the epoxy resin coating and the silicone rubber coating were actually attached to the fixing apparatus and printing was performed.

Figure 24:
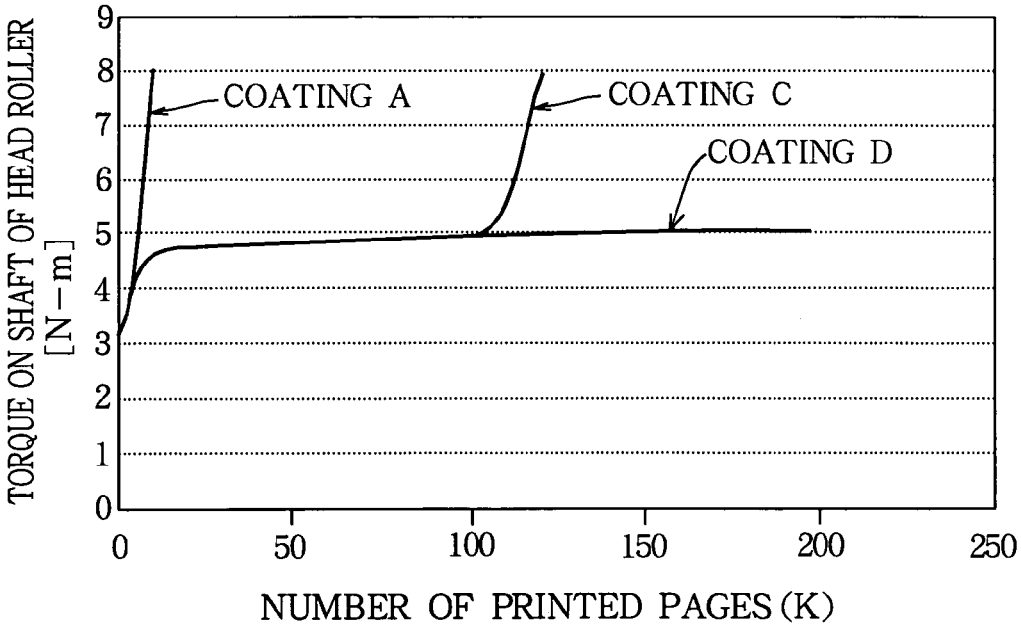
FIG. 24 illustrates changes in torque load during continuous printing.

For the epoxy resin coating, the pressure pad became cracked after printing 10K pages. The silicone rubber as a resilient body was exposed and therefore required a drive torque larger than a tolerable value. FIG. 24 illustrates changes in torque load during continuous printing.

The epoxy resin coating (Coating A) became cracked because the material is harder and thinner than rubber and is therefore poor in flexibility. It is considered that the epoxy resin coating fails to follow the deformation of silicone rubber that forms the resilient body 50*b* and is therefore subjected to fatigue due to repetitive transport of recording medium P and becomes cracked.

The silicone rubber coating (Coating C) filled a requirement of lifetime but became cracked shortly after printing 120K pages and flaked. Thus, the silicone rubber coating (Coating C) cannot be said to have a sufficiently long life. After investigating the type of damage to the silicone rubber coating, the inventors considered that silicone rubber needs to have a higher tearing strength and adhesive properties. Epoxy denatured silicone was added for increasing tearing strength and amino silane was added for improving adhesion properties. As a result, this silicone rubber coating (Coating D) did not become damaged after continuous printing of 200K pages. As shown in FIG. 24, the torque load became stable after initial changes.

As described above, adding epoxy denatured silicone and amino silane increases the tearing strength and adhesive properties of the coating. Adding graphite as a solid lubricant provides the ability of the coating to slide on the belt. Thus, the twelfth embodiment implements a low cost fixing apparatus that does not cause damage to the pressure pad and an increase in torque load and ensures a stable, reliable operation of the pressure pad.

Although graphite is used as a solid lubricant in the twelfth embodiment, slip material such as tetrafluoroethylene, powder of TEFLON, and molybdenum disulfide may also be used for similar effect.

Thirteenth Embodiment

Figure 25:
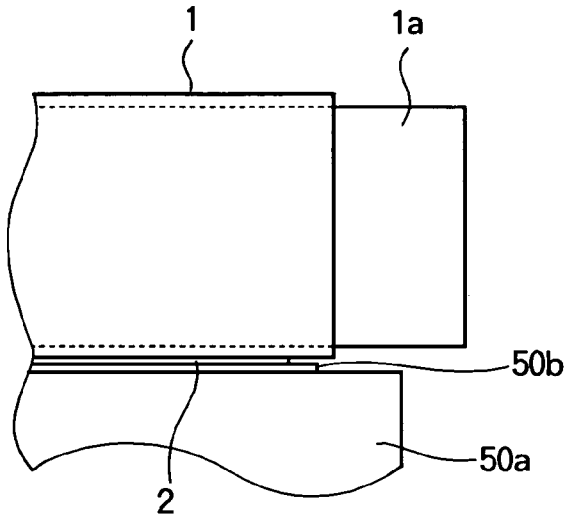
FIGS. 25-27 are fragmentary views illustrating the positional relations between a resilient body of a pressure pad and the belt near one end portion of a belt.
Figure 26:
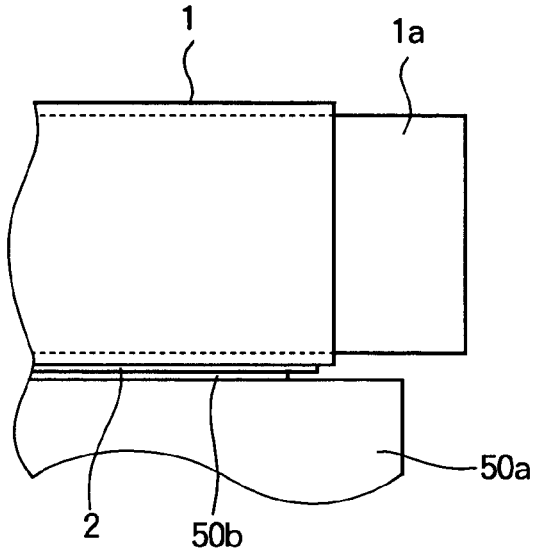
Figure 27:
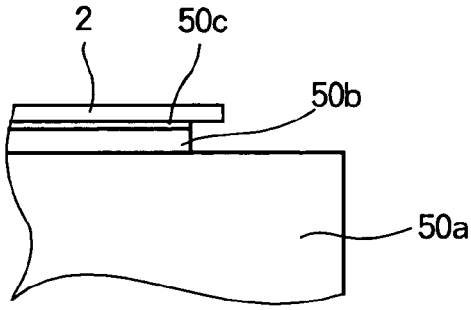
Figure 28:
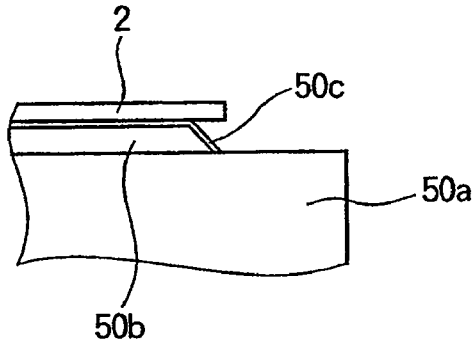
FIG. 28 is a fragmentary view illustrating the surface of the coating that is in contact with an area of the belt inner than an edge of the belt.
Figure 29:
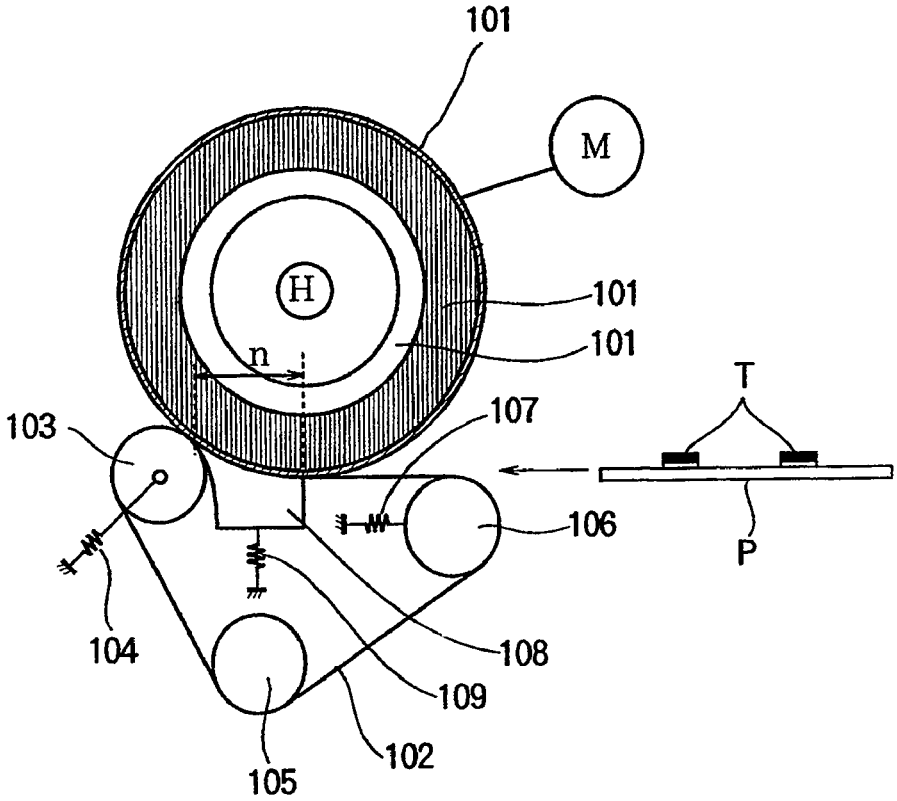
FIG.29 (Prior Art)
FIG. 29 illustrates one such conventional belt nip type fixing apparatus.

FIGS. 25-27 are fragmentary views illustrating the positional relations between a resilient body 50*b* of a pressure pad 50 and a belt 2 near one end portion of the belt 2. FIG. 28 is a fragmentary view illustrating the surface of the coating 50*c* that is in contact with an area of the belt 2 inner than an edge of the belt 2.

As shown in FIG. 25, if the longitudinal end of the resilient body 50*b* extends further than the edge of the belt 2 in a direction of the width of the belt 2, a large stress is exerted on the resilient body 50*b* in an area on which the edge of the belt 2 slides. Thus, the coating on the resilient body 50*b* becomes apt to flake. In order to solve this problem, the edge of the belt 2 is required to extend further than the longitudinal end of the resilient body 50*b* in the direction of the width of the belt 2. If the surface of an end of the resilient body 50*b* is not coated and at substantially right angles with respect to the inner surface of the belt 2, the coating tends to flake at its edge and becomes unreliable.

There is no coating beyond the end of the sliding surface of the resilient body 50*b* and therefore the bonding force at the end of the sliding surface is not large enough to maintain the edge of the coating in a firmly bonded condition. In general, spray coating fails to deposit the coating material on a surface substantially parallel to a direction of spraying. In order to ensure that the coating material is deposited on the surface parallel to the direction of spraying, the nozzle should be inclined relative to the object or the object should be tilted relative to the nozzle. This leads to an increase in manufacturing cost.

Referring to FIG. 28, the widthwise end of the belt 2 extends further than the longitudinal end of the sliding surface of the resilient body 50*b* in the direction of the width of the belt 2. The resilient body 50*b* has a tapered longitudinal end portion having an inclined surface 50*c* that extends to the body 50*a*of the pressure pad 50 in such a direction as to be away from the belt 2. The coating is also applied to the inclined surface 50*c*. Thus, the coating on the sliding surface of the resilient body 50*b* is contiguous to the coating on the inclined surface 50*c*, so that the coating on the sliding surface is difficult to flake.

In the thirteenth embodiment, the coating applied on the resilient body 50*b* extends further outwardly than the widthwise end of the belt 2, thereby ensuring stable running of the belt 2 as well as implementing an inexpensive, highly reliable fixing apparatus.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fixing apparatus that transports a recording medium carrying a developer image on it and heats the developer image to fix into the recording medium, the apparatus comprising:

a rotating body that extends in a first direction parallel to a rotational axis and generates heat;

an endless belt that runs in a second direction substantially perpendicular to the first direction;

a pressure roller that extends substantially parallel to said rotating body, said pressure roller being rotatable in pressure contact with said endless belt such that said endless belt is sandwiched between said rotating body and said pressure roller; and a pressure pad that extends substantially parallel to said rotating body, said pressure pad including a pressure surface that urges said endless belt against said rotating body from inside of said endless belt, the pressure surface being in an area between said pressure roller and a belt guide, the belt guide cooperating with said pressure roller and said pressure pad in holding said endless belt without tension, said belt guide including a first outer surface on a side of said belt guide substantially opposite a second outer surface of said rotating body, wherein said pressure roller and said pressure pad press said endless belt against the second surface and the first outer surface guides said endless belt to run along the first outer surface, wherein when said rotating body rotates, said endless belt is driven in rotation in such a way that the recording medium is pulled in between said rotating body and said endless belt.

2. The fixing apparatus according to claim 1, wherein the pressure pad extends in the second direction and the pressure surface has a recess therein extending in the second direction.

3. The fixing apparatus according to claim 1, wherein the pressure surface has a radius of curvature.

4. The fixing apparatus according to claim 1, further comprising a gap-defining member which defines a gap between the pressure roller and the pressure pad.

5. The fixing apparatus according to claim 4, wherein the gap-defining member is a bearing that abuts the pressure pad to prevent the pressure pad from contacting the pressure roller.

6. The fixing apparatus according to claim 1, wherein the pressure surface has resiliency.

7. The fixing apparatus according to claim 1, wherein the pressure surface has longitudinal end portions tapered such that the pressure surface is away from said endless belt nearer longitudinal ends of the pressure surface.

8. The fixing apparatus according to claim 1, wherein the pressure roller and the pressure pad are received in said belt guide.

9. The fixing apparatus according to claim 1, wherein the pressure pad is disposed upstream of the pressure roller with respect to the second direction.

10. The fixing apparatus according to claim 1, wherein the pressure pad is formed a plate-like member bent into a substantially L-shape.

11. The fixing apparatus according to claim 1, wherein said rotating body has a cylindrical surface and the pressure pad has a curved pressure surface concentric to the cylindrical surface of said rotating body and urges said endless belt.

12. The fixing apparatus according to claim 1, wherein said belt guide accommodates the pressure pad and an urging member that urges the pressure pad against said rotating body.

13. The fixing apparatus according to claim 1, wherein the pressure pad has a pressure surface that extends in the first direction and wherein an urging member urges the pressure pad in such a way that a longitudinal middle portion of the pressure surface extends toward said rotating body more than longitudinal ends of the pressure surface.

14. The fixing apparatus according to claim 1, wherein the pressure roller has a large diameter at its longitudinal middle and a small diameter at its longitudinal ends such that the diameter of the pressure roller is larger nearer the longitudinally middle of the pressure roller.

15. The fixing apparatus according to claim 1, further comprising a wear resistant member disposed between the pressure pad and said endless belt, the wear resistant member having wear resistance.

16. The fixing apparatus according to claim 1, wherein said rotating body has a first dimension in the first direction, and the pressure roller has a second dimension in a direction parallel to the rotational axis of the rotating body and wherein the first dimension and the second dimension are greater than a width of said endless belt.

17. The fixing apparatus according to claim 1, wherein said belt guide receives an oil-supplying member therein, the oil-supplying member being exposed on a surface of said belt guide in contact with said endless belt.

18. The apparatus according to claim 1, wherein said pressure pad and said pressure roller are adjacent to each other in an area in which said pressure pad and said pressure roller are in contact with said endless belt.

19. The apparatus according to claim 1, wherein said pressure surface projects substantially toward said pressure roller.

20. The apparatus according to claim 1, wherein said belt guide includes a grove in which said pressure roller and said pressure pad are received, said belt guide maintaining said belt substantially in the shape of a hollow cylinder.

21. The fixing apparatus according to claim 1, wherein said pressure roller presses said endless belt against said rotating body, said pressure roller being in contact with said endless belt in an area between said pressure pad and said belt guide.

22. A fixing apparatus that transports a recording medium carrying a developer image on it and heats the developer image to fix into the recording medium, the apparatus comprising:

a rotating body that extends in a first direction parallel to a rotational axis of said rotating body and generates heat;

an endless belt that runs in a second direction substantially perpendicular to the first direction;

a belt guide on which said endless belt is loosely entrained; and a pressurizing mechanism that engages said endless belt from inside and urges said endless belt against said rotating body, the pressurizing mechanism including a pressure roller that extends substantially parallel to said rotating body and urges said endless belt against said rotating body while rotating and a pressure pad that extends substantially parallel to said rotating body and has a pressure surface that urges said endless belt against said rotating body, the pressure pad extending in the second direction and the pressure surface having a recess therein extending in the second direction, wherein when said rotating body rotates, said endless belt is driven in rotation in such a way that the recording medium is pulled in between said rotating body and said endless belt.

23. The fixing apparatus according to claim 22, wherein the pressure surface has a first surface, a second surface, and a third surface in pressure contact with said endless belt;

wherein the first surface is on an upstream side with respect to the second direction, the second surface is on a downstream side with respect to the second direction, and a third surface is between the first surface and the second surface;

wherein the third surface is pressed against said endless belt under a lower pressure force than the first surface and the second surface.

24. A fixing apparatus that transports a recording medium carrying a developer image on it and heats the developer image to fix into the recording medium, the apparatus comprising:

a rotating body that extends in a first direction parallel to a rotational axis of said rotating body and generates heat;

an endless belt that runs in a second direction substantially perpendicular to the first direction;

a belt guide on which said endless belt is loosely entrained;

a pressurizing mechanism that engages said endless belt from inside and urges said endless belt against said rotating body, the pressurizing mechanism including a pressure roller that extends substantially parallel to said rotating body and urges said endless belt against said rotating body while rotating and a pressure pad that extends substantially parallel to said rotating body and has a pressure surface that urges said endless belt against said rotating body; and a gap-defining member which defines a gap between the pressure roller and the pressure pad, wherein when said rotating body rotates, said endless belt is driven in rotation in such a way that the recording medium is pulled in between said rotating body and said endless belt.

25. The fixing apparatus according to claim 24, wherein the gap-defining member is a bearing that abuts the pressure pad to prevent the pressure pad from contacting the pressure roller.

26. The fixing apparatus according to claim 24, wherein the gap-defining member is a spacer disposed between the pressure roller and the pressure pad, the spacer being made of polytetrafluoro-ethylene.

27. A fixing apparatus that transports a recording medium carrying a developer image on it and heats the developer image to fix into the recording medium, the apparatus comprising:

a rotating body that extends in a first direction parallel to a rotational axis of said rotating body and generates heat;

an endless belt that runs in a second direction substantially perpendicular to the first direction;

a belt guide on which said endless belt is loosely entrained; and a pressurizing mechanism that engages said endless belt from inside and urges said endless belt against said rotating body, the pressurizing mechanism including a pressure roller that extends substantially parallel to said rotating body and urges said endless belt against said rotating body while rotating and a pressure pad that extends substantially parallel to said rotating body and has a pressure surface that urges said endless belt against said rotating body, the pressure surface having longitudinal end portions tapered such that the pressure surface is away from said endless belt nearer longitudinal ends of the pressure surface, wherein when said rotating body rotates, said endless belt is driven in rotation in such a way that the recording medium is pulled in between said rotating body and said endless belt.

28. A fixing apparatus that transports a recording medium carrying a developer image on it and heats the developer image to fix into the recording medium, the apparatus comprising:

a rotating body that extends in a first direction parallel to a rotational axis of said rotating body and generates heat;

an endless belt that runs in a second direction substantially perpendicular to the first direction;

a belt guide on which said endless belt is loosely entrained; and a pressurizing mechanism that engages said endless belt from inside and urges said endless belt against said rotating body, the pressurizing mechanism including a pressure roller that extends substantially parallel to said rotating body and urges said endless belt against said rotating body while rotating and a pressure pad that extends substantially parallel to said rotating body and has a pressure surface that urges said endless belt against said rotating body, the pressure pad having a pressure surface that extends in the first direction, the belt guide accommodating the pressure pad and an urging member that urges the pressure pad against said rotating body;

wherein when said rotating body rotates, said endless belt is driven in rotation in such a way that the recording medium is pulled in between said rotating body and said endless belt; and wherein the urging member urges the pressure pad at longitudinal end portions and longitudinal middle portions of the pressure pad, applying a larger urging force at the longitudinal middle portion than at the longitudinal end portions.

29. A fixing apparatus that transports a recording medium carrying a developer image on it and heats the developer image to fix into the recording medium, the apparatus comprising:

a rotating body that extends in a first direction parallel to a rotational axis of said rotating body and generates heat;

an endless belt that runs in a second direction substantially perpendicular to the first direction;

a belt guide on which said endless belt is loosely entrained; and a pressurizing mechanism that engages said endless belt from inside and urges said endless belt against said rotating body, the pressurizing mechanism including a pressure roller that extends substantially parallel to said rotating body and urges said endless belt against said rotating body while rotating and a pressure pad that extends substantially parallel to said rotating body and has a pressure surface that urges said endless belt against said rotating body, the pressure pad having a pressure surface that extends in the first direction, wherein when said rotating body rotates, said endless belt is driven in rotation in such a way that the recording medium is pulled in between said rotating body and said endless belt, and wherein the urging member urges the pressure pad in such a way that the pressure surface extends toward said rotating body nearer the longitudinal middle portion.

30. A fixing apparatus that transports a recording medium carrying a developer image on it and heats the developer image to fix into the recording medium, the apparatus comprising:

a rotating body that extends in a first direction parallel to a rotational axis of said rotating body and generates heat;

an endless belt that runs in a second direction substantially perpendicular to the first direction;

a belt guide on which said endless belt is loosely entrained; and a pressurizing mechanism that engages said endless belt from inside and urges said endless belt against said rotating body, the pressurizing mechanism including a pressure roller that extends substantially parallel to said rotating body and urges said endless belt against said rotating body while rotating and a pressure pad that extends substantially parallel to said rotating body and has a pressure surface that urges said endless belt against said rotating body, the pressure roller having a large diameter at its longitudinal middle and a small diameter at its longitudinal ends such that the diameter of the pressure roller is larger nearer the longitudinally middle of the pressure roller, wherein when said rotating body rotates, said endless belt is driven in rotation in such a way that the recording medium is pulled in between said rotating body and said endless belt.

31. A fixing apparatus that transports a recording medium carrying a developer image on it and heats the developer image to fix into the recording medium, the apparatus comprising:

a rotating body that extends in a first direction parallel to a rotational axis of said rotating body and generates heat;

an endless belt that runs in a second direction substantially perpendicular to the first direction;

a belt guide on which said endless belt is loosely entrained; and a pressurizing mechanism that engages said endless belt from inside and urges said endless belt against said rotating body, the pressurizing mechanism including a pressure roller that extends substantially parallel to said rotating body and urges said endless belt against said rotating body while rotating and a pressure pad that extends substantially parallel to said rotating body and has a pressure surface that urges said endless belt against said rotating body, wherein when said rotating body rotates, said endless belt is driven in rotation in such a way that the recording medium is pulled in between said rotating body and said endless belt, and wherein said rotating body has a first dimension in the first direction, and the pressure roller has a second dimension in a direction parallel to the rotational axis of the rotating body, wherein both the first dimension and the second dimension are greater than a width of said endless belt.

32. A fixing apparatus that transports a recording medium carrying a developer image on it and heats the developer image to fix into the recording medium, the apparatus comprising:

a rotating body that extends in a first direction parallel to a rotational axis and generates heat;

an endless belt that runs in a second direction substantially perpendicular to the first direction;

a pressure roller that extends substantially parallel to said rotating body, said pressure roller being rotatable in contact with said endless belt such that said endless belt is sandwiched between said rotating body and said pressure roller;

a pressure pad that extends substantially parallel to said rotating body, said pressure pad including a pressure surface that urges said endless belt against said rotating body from inside of said endless belt; and a belt guide that houses said pressure roller and said pressure pad such that said pressure roller and said pressure pad are substantially adjacent in an area in which said pressure roller and said pressure pad are in contact with said endless belt, said belt guide being of a generally cylindrical shape on which said endless belt is loosely entrained such that said endless belt is maintained substantially in the shape of a hollow cylinder;

wherein when said rotating body rotates, said endless belt is driven in rotation such that the recording medium is pulled in between said rotating body and said endless belt.

33. The fixing apparatus according to claim 32, wherein the pressure surface has a radius of curvature.

34. The fixing apparatus according to claim 32, wherein the pressure surface has resiliency.

35. The fixing apparatus according to claim 34, wherein the pressure surface has a surface roughness expressed in terms of ten-point height of irregularities greater than 5 μm.

36. The fixing apparatus according to claim 34, wherein the pressure surface is made of a resilient base material to which a solid lubricant is added.

37. The fixing apparatus according to claim 36, wherein the resilient base material is a silicone rubber material.

38. The fixing apparatus according to claim 37, wherein one of epoxy denatured silicone and amino silane is added to the resilient base material.

39. The fixing apparatus according to claim 36, wherein the solid lubricant is one of graphite, tetrafluoroethylene, powder of tetrafluoroethylene, and molybdenum disulfide.

40. The fixing apparatus according to claim 32, wherein the pressure pad is disposed upstream of the pressure roller with respect to the second direction.

41. The fixing apparatus according to claim 32, wherein the pressure pad is formed a plate-like member bent into a substantially L-shape.

42. The fixing apparatus according to claim 32, wherein said rotating body has a cylindrical surface and the pressure pad has a curved pressure surface concentric to the cylindrical surface of said rotating body and urges said endless belt.

43. The fixing apparatus according to claim 32, further comprising a wear resistant member disposed between the pressure pad and said endless belt, the wear resistant member having wear resistance.

44. The fixing apparatus according to claim 43, further comprising a resilient member disposed between the pressure pad and the wear resistant member.

45. The fixing apparatus according to claim 44, wherein the resilient member is made of silicone resin.

46. The fixing apparatus according to claim 43, wherein the wear resistant member contains a glass fiber material.

47. The fixing apparatus according to claim 46, wherein the wear resistant member further includes fluoroplastic.

48. The fixing apparatus according to claim 32, wherein said belt guide receives an oil-supplying member therein, the oil-supplying member being exposed on a surface of said belt guide in contact with said endless belt.

* * * * *